US010522067B2

(12) United States Patent
Sugiyama et al.

(10) Patent No.: US 10,522,067 B2
(45) **Date of Patent: *Dec. 31, 2019**

(54) APPARATUS AND METHOD FOR ADJUSTING DISPLAY CHARACTERS OF DISPLAY DEVICE

(71) Applicant: Synaptics Japan GK, Tokyo (JP)

(72) Inventors: Akio Sugiyama, Tokyo (JP); Takashi Nose, Tokyo (JP); Hirobumi Furihata, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 43 days.

This patent is subject to a terminal disclaimer.

(21) Appl. No.: 15/911,876

(22) Filed: Mar. 5, 2018

(65) Prior Publication Data

US 2018/0197450 A1 Jul. 12, 2018

Related U.S. Application Data

(63) Continuation of application No. 14/157,415, filed on Jan. 16, 2014, now Pat. No. 9,911,371.

(30) Foreign Application Priority Data

Jan. 18, 2013 (JP) ..... 2013007809

(51) Int. Cl.
*G09G 3/20* (2006.01)

(52) U.S. Cl.
CPC ..... *G09G 3/20* (2013.01); *G09G 2320/0626* (2013.01); *G09G 2320/0666* (2013.01); (Continued)

(58) Field of Classification Search
CPC ..... G09G 2360/16; G09G 2360/145; G09G 2320/0693; G09G 2320/0666; G09G 2320/0626; G09G 3/20
See application file for complete search history.

(56) References Cited

U.S. PATENT DOCUMENTS 8,363,180 B2 1/2013 Matsui et al.
8,553,176 B2 10/2013 Matsui et al.
(Continued)

FOREIGN PATENT DOCUMENTS

CN 102473381 A 5/2012
CN 102549649 A 7/2012
(Continued)

OTHER PUBLICATIONS

Chinese Office Action dated Apr. 26, 2017 with English Translation thereof.
(Continued)

*Primary Examiner* — Mihir K Rayan
(74) *Attorney, Agent, or Firm* — Patterson + Sheridan, LLP

(57) ABSTRACT

A display panel driver includes an image data generator, a brightness correction circuit performing a correction calculation on image data, a drive section driving the display panel in response to corrected image data; and a display timing generator outputting a timing control signal. The correction calculation by the brightness correction circuit is adjustable. When the display panel driver is placed into a test mode, the display timing generator is configured to output an internally-generated timing control signal and the image data generator outputs internally-generated evaluation image data. The evaluation image data are generated so that the evaluation images are switched from one to another in response to the internally-generated timing control signal.

20 Claims, 20 Drawing Sheets

(52) U.S. Cl.
CPC ..... *G09G 2320/0693* (2013.01); *G09G 2360/145* (2013.01); *G09G 2360/16* (2013.01)

(56) References Cited

U.S. PATENT DOCUMENTS

| | | | | |
|---|---|---|---|---|
| 8,681,087 | B2 | 3/2014 | Otoi et al. | |
| 9,911,371 | B2 * | 3/2018 | Sugiyama | G09G 3/20 |
| 2003/0197709 | A1 | 10/2003 | Shimazaki et al. | |
| 2003/0231193 | A1 | 12/2003 | Shimazaki et al. | |
| 2004/0263456 | A1 | 12/2004 | Miyachi et al. | |
| 2005/0012727 | A1 | 1/2005 | Kamiyama | |
| 2005/0103976 | A1 | 5/2005 | Ioka et al. | |
| 2005/0140907 | A1 * | 6/2005 | Yun | G02F 1/133514 349/144 |
| 2005/0168458 | A1 * | 8/2005 | Kang | G09G 3/006 345/213 |
| 2006/0066642 | A1 | 3/2006 | Ookawara et al. | |
| 2007/0052735 | A1 | 3/2007 | Chou | |
| 2007/0236243 | A1 | 10/2007 | Park et al. | |
| 2010/0026730 | A1 | 2/2010 | Okutani | |
| 2012/0062621 | A1 * | 3/2012 | Miyahara | G09G 5/10 345/690 |
| 2012/0176419 | A1 | 7/2012 | Otoi et al. | |
| 2012/0206504 | A1 | 8/2012 | Ha et al. | |
| 2012/0212520 | A1 | 8/2012 | Matsui et al. | |
| 2013/0106924 | A1 | 5/2013 | Matsui et al. | |
| 2014/0232625 | A1 | 8/2014 | Murase et al. | |
| 2014/0306976 | A1 | 10/2014 | Sugiura et al. | |
| 2014/0306979 | A1 | 10/2014 | Chun et al. | |

FOREIGN PATENT DOCUMENTS

| | | | |
|---|---|---|---|
| JP | H05-064037 | A | 3/1993 |
| JP | H07-56545 | A | 3/1995 |
| JP | H08-160883 | A | 6/1996 |
| JP | 2004023328 | A | 1/2004 |
| JP | 2004146936 | A | 5/2004 |
| JP | 2005099828 | A | 4/2005 |
| JP | 2006106121 | A | 4/2006 |
| JP | 2007121730 | A | 5/2007 |
| JP | 2007147696 | A | 6/2007 |
| JP | 2008042843 | A | 2/2008 |

OTHER PUBLICATIONS

Japanese Office Action dated Oct. 5, 2016 iwth English Translation thereof.

* cited by examiner

APPARATUS AND METHOD FOR ADJUSTING DISPLAY CHARACTERS OF DISPLAY DEVICE

CROSS REFERENCE

This application is a continuation of U.S. patent application Ser. No. 14/157,415 filed Jan. 16, 2014 which claims priority from Japanese Patent Application Number JP 2013-007809, filed on Jan. 18, 2013, the content of which are hereby incorporated by reference into this application.

TECHNICAL FIELD

The present invention relates to a display panel driver, a panel display device and an adjustment device, in particular, to an adjustment of a display panel driver for displaying quality-improved images on a display panel driven by the display panel driver.

BACKGROUND ART

Panel display devices, such as liquid crystal display devices, require adjustment of display characteristics to obtain accurate output images for input image data. Examples of display characteristics to be adjusted include the color temperature of the white point (or the white balance) and the gamma value, for example.

The color temperature of the white point influences the color tone of the image. The specifications of many of recent display devices define that the color temperature of the white point is adjusted to 6504K (that is, the chromaticity coordinates (x, y)=(0.313, 0.329)). In this case, the setting of the display device should be adjusted so that the color temperature of the white point is kept constant for all of the allowed gray levels with respect to any grayscale images in which the gray levels of red, green and blue of every pixel are the same value.

FIG. 1 illustrates an example in which the color temperature of the white point is adjusted to 6504K in a normally-black liquid crystal display device which displays images in response to image data which represent the gray level of each color (red, green and blue) of each pixel with eight bits. With respect to all grayscale images in which the gray levels of red, green and blue are the same value, the color temperature of the white point is adjusted to 6504K for all of the allowed gray levels from 00h to FFh. It should be noted that the symbol "h" represents the hexadecimal notation.

The gamma value, on the other hand, influences the linearity or non-linearity between the gray level of image data and the actual brightness of the pixel. The input-output characteristics of a display device can be represented by the following expression:

$$V_{OUT}=V_{IN}^{\gamma},$$

where $V_{IN}$ is the input signal or input data, $V_{OUT}$ is the output signal or input data, and $\gamma$ is the gamma value. The specifications of many of display devices define that the gamma value $\gamma$ is 2.2 and display devices are generally configured so that the gamma value is kept at 2.2, when displaying grayscale images in which the gray levels of red, green and blue of each pixel are the same value, while varying the gray levels. FIG. 2 illustrates an example in which the gamma value is adjusted to 2.2 in a normally-black liquid crystal display device which is adapted to image data which represent the gray level of each color (red, green and blue) of each pixel with eight bits (that is, image data which represent each color with 256 ($=2^8$) allowed gray levels).

One issue is that the characteristics of panel display devices, such as the color temperature of the white point and the gamma value, vary depending on the panel display devices due to the individual variations of the color filter and the backlight. In order to improve the product quality, it is desirable to compensate such individual variations.

One method for adjustment of display characteristics of a panel display device is to adjust the settings of a brightness correction circuit integrated in a display panel driver which drives the display panel. A brightness correction circuit is a sort of circuit which performs a correction calculation on input image data fed to a display panel driver, and image data obtained by the correction calculation by the brightness correction circuit (that is, corrected image data) are actually used to display images on the display panel. It is possible to adjust the color temperature of the white point and the gamma value by adjusting the settings of the brightness correction circuit and to thereby achieve compensation of the individual vitiations among display devices.

In relation to such technique, Japanese patent application publication No. H05-064037 discloses a technique in which the brightness of an optical modulated output obtained from a liquid crystal display device is measured while a video signal is externally fed to the liquid crystal display device, and the gamma correction data of a gamma correction device are adjusted on the basis of the measurement result.

The technique disclosed in this patent document, however, requires feeding the video signal (that is, image data) to the liquid crystal display device when the settings of the gamma correction device are adjusted, and this implies that it is necessary for an adjustment device used for setting the gamma correction device to have the function of feeding the video signal to the liquid crystal display device. The provision of the function of feeding the video signal to the liquid crystal display device to the adjustment device results in an increase in the cost of the adjustment device. This problem is especially severe in adjustment of settings of a brightness correction circuit of a display panel driver in a panel display device using a recent high-speed serial interface. The provision of the function of transmitting a video signal with a high-speed serial interface, which achieves a high-speed signal transmission, to the adjustment device undesirably increases the cost.

SUMMARY OF THE INVENTION

Accordingly, an objective of the present invention is to provide a technique for adjusting display characteristics of a panel display device with a reduced cost.

Other objectives of the present invention will be understood from the description of preferred embodiments.

In an aspect of the present invention, a display panel driver for driving a display panel includes: an image data generator; a brightness correction circuit performing a correction calculation on image data fed from the image data generator to generate corrected image data; a drive section driving the display panel in response to the corrected image data; and a display timing generator outputting a biasing control signal. The correction calculation performed by the brightness correction circuit is adjustable by a setting. The display timing generator outputs an internal timing control signal generated by a display timing generator circuit disposed in the display timing generator as the timing control signal, when said display panel driver is placed into a first state. The image data generator outputs, as the image data, evaluation image data which correspond to evaluation images to be displayed on a display region or the display panel and are generated by an evaluation image data generator circuit disposed in the image data generator, when the display panel driver is placed into the first state. When the display panel driver is placed into the first state, the evaluation image data generator circuit generates the evaluation image data so that the evaluation images are switched from one to another in response to the timing control signal.

In another aspect of the present invention, a display device includes a display panel and a display panel driver driving the display panel. The display panel driver includes: an image data generator; a brightness correction circuit performing a correction calculation on image data fed from the image data generator to generate corrected image data; a drive section driving the display panel in response to the corrected image data; and a display timing generator outputting a timing control signal. The correction calculation performed by the brightness correction circuit is adjustable by a setting. The display timing generator outputs an internal timing control signal generated by a display timing generator circuit disposed in the display timing generator as the timing control signal, when the display panel driver is placed into a first state. The image data generator outputs, as the image data, evaluation image data which correspond to evaluation images to be displayed on a display region of the display panel and are generated by an evaluation image data generator circuit disposed in the image data generator, when the display panel driver is placed into the first state. When the display panel driver is placed into the first state, the evaluation image data generator circuit generates the evaluation image data so that the evaluation images are switched from one to another in response to the timing control signal.

In still another aspect of the present invention, an adjustment device includes: a first interface unit used to communicate with a display panel driver which includes a brightness correction circuit adapted to perform a correction calculation on external image data externally fed to the display panel driver to generate corrected image data and a drive section driving a display panel in response to the corrected image data; a second interface unit used to communicate with a display characteristics measurement device which measures image characteristics of evaluation images displayed on a display section of the display panel; and a correction parameter calculation device. The correction parameter calculation device is configured to set the display panel driver into a state for displaying the evaluation images on a display section of the display panel, to generate a display characteristics measurement device control signal controlling a display characteristics measurement device which measures image characteristics of the evaluation images displayed on the display section of the display panel, to calculate a correction parameter value specifying the relation between the external image data and the corrected image data in the correction calculation, based on measurement data of the image characteristics received from the display characteristics measurement device, and to transmit a correction parameter write command describing the calculated correction parameter to the display panel driver via the first interface unit.

The present invention effectively provides a technique for adjusting display characteristics of a panel display device with a reduced cost.

BRIEF DESCRIPTION OF THE DRAWINGS

The above and other advantages and features of the present invention will be more apparent from the following description taken in conjunction with the accompanied drawings, in which.

DESCRIPTION OF PREFERRED EMBODIMENTS

First Embodiment (Overall Configuration)

Figure 1:
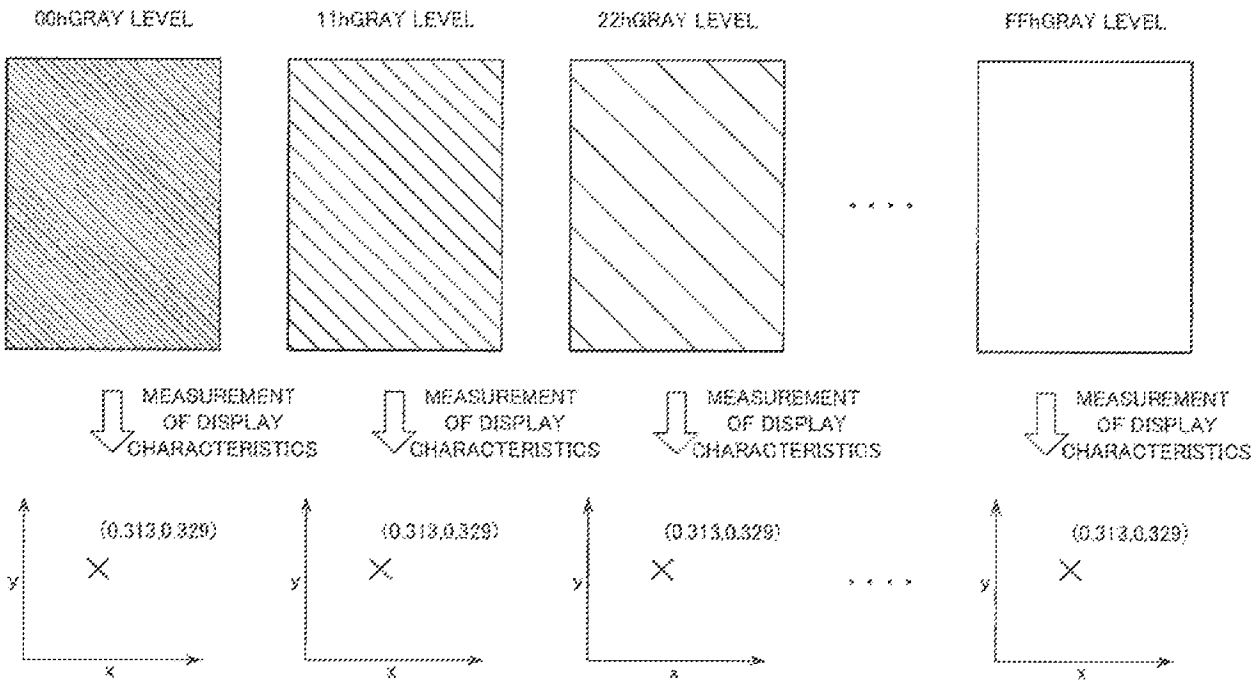
FIG. 1 is a conceptual diagram illustrating an example of adjustment of the color temperature of the white point of a panel display device.
Figure 2:
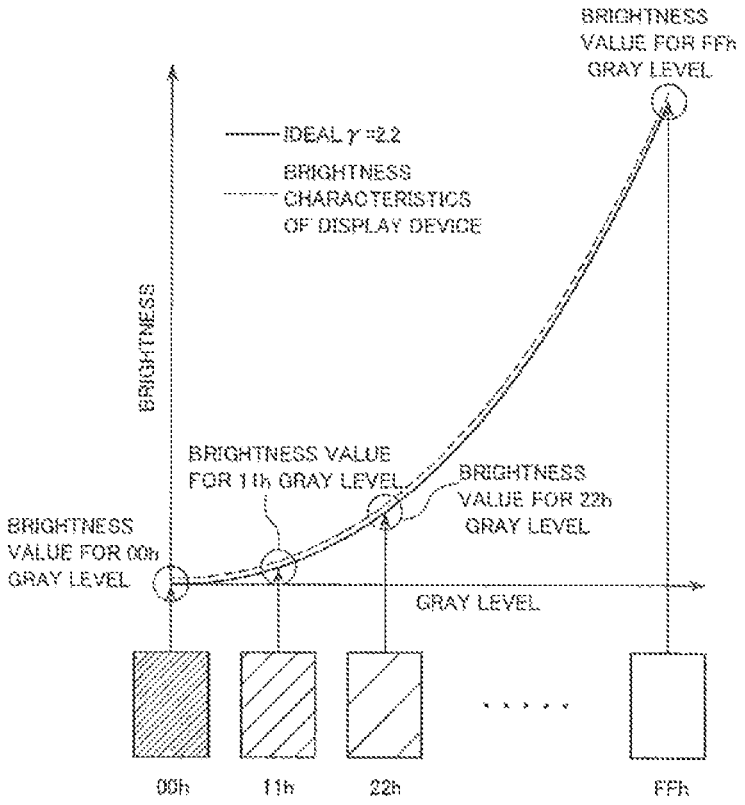
FIG. 2 is a conceptual diagram illustrating an example of adjustment of the gamma characteristics of a panel display device.
Figure 3:
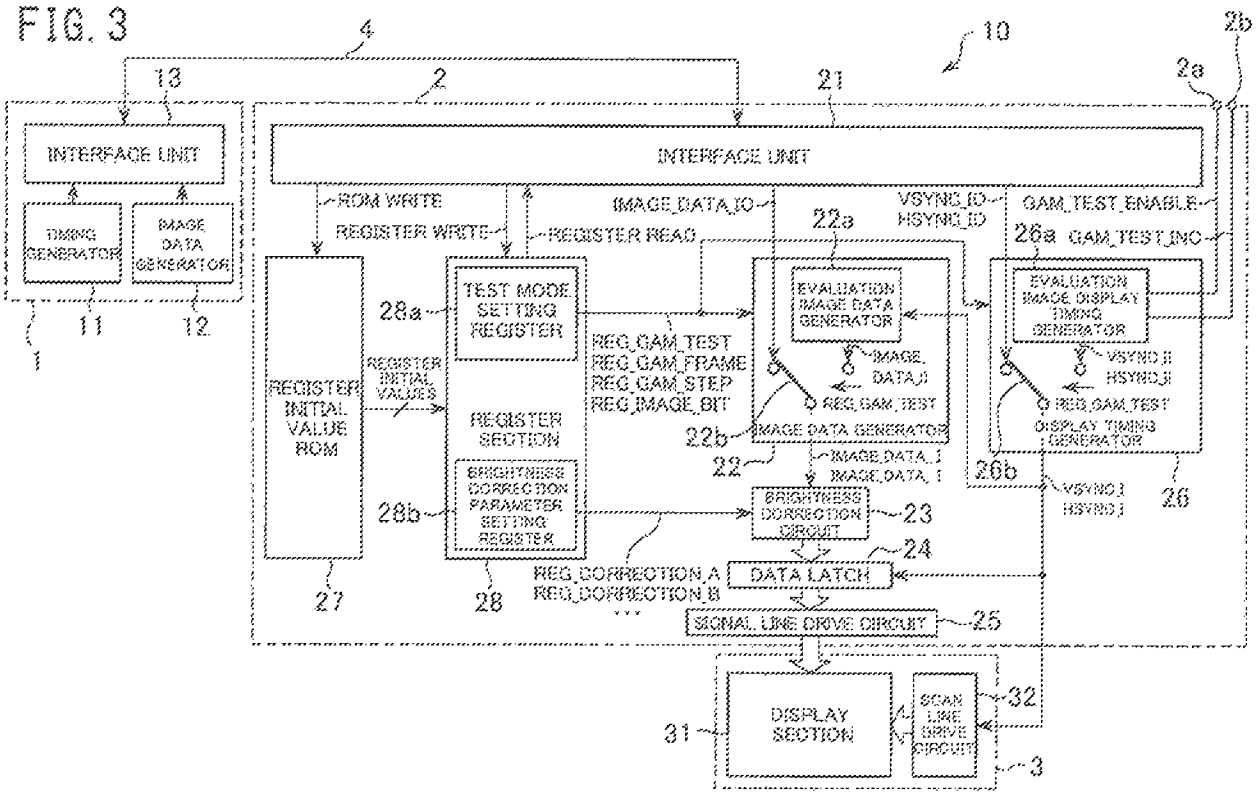
FIG. 3 is a block diagram illustrating an exemplary configuration of a display device in a first embodiment of the present invention.

FIG. 3 is a block diagram illustrating an exemplary configuration of a display device 10 in a first embodiment of the present invention. The display device 10 is configured as a liquid crystal display device, including a timing controller 1, a display controller/driver 2 and a liquid crystal display panel 3. The timing controller 1 and the display controller/driver 2 are connected via a high-speed data communication line 4 to mutually communicate data by high-speed interface signals transmitted over the high-speed data communication line 4.

The timing controller 1 functions as a control section which controls the operation of the display controller/driver 2 (in the normal operation). The timing controller 1 includes a timing generator 11, an image data generator 12 and an interface unit 13. The timing generator 11 generates timing control data for controlling the operation timing of the display controller/driver 2. The timing control data may include: VSYNC commands used for generation of a vertical synchronization signal in the display controller/driver 2; HSYNC commands used for generation of a horizontal synchronization signal; data start commands each indicating a start of image data transmission; and data end commands each indicating an end of the image data transmission. The image data generator 12 generates image data corresponding to images to be displayed on the liquid crystal display panel 3. The image data indicate the gray level of each color (in this embodiment, red (R), green (G) and blue (B) of each pixel disposed in the liquid crystal display panel 3. The interface unit 13 transmits the timing control data and the image data to the display controller/driver 2 by using a high-speed interface signal transmitted over the high-speed data communication line 4.

The display controller/driver 2 functions as a display panel driver which drives the liquid crystal display panel 3 in response to the timing control data and the image data received from the timing controller 1. Details of the configuration and operation of the display controller/driver 2 will be described later.

The liquid crystal display panel 3 includes a display section 31 and a scan line drive circuit 32. The display section 31 includes pixels arrayed in rows and columns, a plurality of signal lines and a plurality of scan lines. In this embodiment, each pixel includes three subpixels; an R subpixel displaying red (R), a G subpixel displaying green (G) and a B subpixel displaying blue (B). The image data describe the values of the gray levels of red, green and blue of each pixel, that is, the gray levels of the R subpixel, G subpixel and B subpixel of each pixel. Each subpixel is located at an intersection of a signal line and a scan line. The signal lines of the display section 31 are driven by the above-described display controller/driver 2 and the scan lines are driven by the scan line drive circuit 32. The scan line drive circuit 32 drives the scan lines in response to a control signal received from the display controller/driver 2. In one embodiment, the scan line drive circuit 32 is integrated on a glass substrate of the liquid crystal display panel 3 by using a COG (circuit on glass) technique. The scan line drive circuit 32 may be implemented as an integrated circuit chip mounted on the glass substrate.

Next, a detailed description is given of the display controller/driver 2 in this embodiment. One feature of the display controller/driver 2 of this embodiment is that the display controller/driver 2 is configured to, when placed into a specific state (or a specific operation mode), sequentially display "evaluation images", which are images used in the adjustment of the display characteristics of the display device 10. In this operation, the display controller/driver 2 itself generates timing control signals used for switching the evaluation images. Such configuration of the display controller/driver 2 of this embodiment eliminates the need of feeding image data corresponding to evaluation images and timing control data to the display controller/driver 2 in the adjustment of the display characteristics of the display device 10, allowing the adjustment of the display characteristics of the display device 10 by using a cost-reduced adjustment device.

Specifically, the display controller/driver 2 of this embodiment includes an interface unit 21, an image data generator 22, a brightness correction circuit 23, a data latch 24, a signal line drive circuit 25, a display timing generator 26, a register initial value ROM (read only memory) 27 and a register section 28.

The interface unit 21 receives the high-speed interface signal from the timing controller 1 via the high-speed data communication line 4. The interface unit 21 has the functions as follows: First, the interface unit 21 transfers the image data transmitted by the high-speed interface signal to the image data generator 22. In FIG. 3, the image data transferred to the image data generator 22 are referred to as external image data IMAGE_DATA_IO. Additionally, the interface unit 21 interprets the timing control data transmitted by the high-speed interface signal to generate timing control signals. The generated timing control signals include an external vertical synchronization signal VSYNC_IO and an external horizontal synchronization signal HSYNC_IO. Furthermore, the interface unit 21 has the function of writing data into the register initial value ROM 27 and the function of writing and reading into and from registers included in the register section 28.

The image data generator 22 feeds image data actually used for driving the signal lines of the display section 31, including an evaluation image data generator circuit 22*a* and a selector 22*b*.

The evaluation image data generator circuit 22*a* is used to generate image data used in the adjustment of the display characteristics of the display device (that is, the adjustment of the settings of the display controller/driver 2), in the display controller/driver 2. The image data generated by the evaluation image data generator circuit 22*a* may be referred to as evaluation image data IMAGE_DATA_II, hereinafter.

The selector 22*b* performs a selection between the external image data IMAGE_DATA_IO received from the interface unit 21 and the evaluation image data IMAGE_DATA_II received from the evaluation image data generator circuit 22*a* and feeds the selected image data to the brightness correction circuit 23. In FIG. 3, the image data fed to the brightness correction circuit 23 are referred to as image data IMAGE_DATA_I. The state of the selector 22*b* is switched in response to a register value REG_GAM_TEST. As described later, when the display controller/driver 2 is placed into the normal operation mode, the register value REG_GAM_TEST is set to "0" (or a first value). The selector 22*b* selects the external image data IMAGE_DATA_IO in response to the register value REG_GAM_TEST being set to "0". When the display controller/driver 2 is set to a test mode, on the other hand, the register value REG_GAM_TEST is set to "1" (or a second value). The selector 22*b* selects the evaluation image data IMAGE_DATA_II in response to the register value REG_GAM_TEST being set to "1".

The brightness correction circuit 23 performs a correction calculation (a gamma correction, for example) on the image data IMAGE_DATA_I and feeds the corrected image data to the data latch 24. The correction of the image data IMAGE_DATA_I is performed in response to at least one brightness correction parameter value REG_CORRECTION, which is fed to the brightness correction circuit 23 from the register section 28. Here, the brightness correction parameter value(s) REG_CORRECTION defines the relation between the gray level values of the image data IMAGE_DATA_I inputted to the brightness correction circuit 23 and the gray level values of the image data outputted from the brightness correction circuit 23. A gamma curve according to which the correction calculation is to be performed is specified by the brightness correction parameter value(s) REG_CORRECTION and the correction calculation corresponding to the specified gamma curve is performed in the brightness correction circuit 23. In this embodiment, a plurality of parameter values are fed as the brightness correction parameter values REG_CORRECTION; two of them are illustrated as brightness correction parameter values REG_CORRECTION_A and REG_CORRECTION_B in FIG. 3.

The data latch 34 and the signal line drive circuit 25 function as a drive section which receives the corrected image data from the brightness correction circuit 23 and drives the liquid crystal display panel 3 in response to the corrected image data. In detail, the data latch 24 receives and latches the corrected image data from the brightness correction circuit 23 in response to a vertical synchronization signal VSYNC_I and a horizontal synchronization signal HSYNC_I fed from the display timing generator 26, and transfers the corrected image data to the signal line drive circuit 25. The signal line drive circuit 25 converts the image data received from the data latch 24 into drive signals with corresponding signal levels, and feeds the drive signals to the signal lines of the display section 31 of the liquid crystal display panel 3.

The display timing generator 26 has the function of generating various timing control signals used in the display controller/driver 2; the display timing generator 26 includes an evaluation image display timing generator circuit 26*a* and a selector 26*b*. The evaluation image display timing generator circuit 26*a* is used to generate timing control signals used in the adjustment of the image displayed on the liquid crystal display panel 3 (that is, the adjustment of the operation of the display controller/driver 2) in the display controller/driver 2. The timing control signals generated by the evaluation image display timing generator circuit 26*a* include an internal vertical synchronization signal VSYNC_II and an internal horizontal synchronization signal HSYNC_II.

The evaluation image display timing generator circuit 26*a* further has the function of generating two control signals to be externally outputted from the display controller driver 2; a test enable signal GAM_TEST_ENABLE and an evaluation image switching signal GAM_TEST_INC. As described later, the test enable signal GAM_TEST_ENABLE and the evaluation image switching signal GAM_TEST_INC are control signals fed to an adjustment device used for the adjustment of the display characteristics of the display device 10 (that is, the adjustment of the settings of the brightness correction circuit 23). The test enable signal GAM_TEST_ENABLE is externally outputted from an external connection terminal 2*a* and the evaluation image switching signal GAM_TEST_INC is externally outputted from an external connection terminal 2*b*.

The selector 26*b* performs a selection between the set of the timing control signals received from the interface unit 21 (including the external vertical synchronization signal VSYNC_IO and the external horizontal synchronization signal HSYNC_IO) and the set of timing control signals received from the evaluation image display timing generator circuit 26*a* (including the internal vertical synchronization signal VSYNC_II and the internal horizontal synchronization signal HSYNC_II) and outputs the selected set of the timing control signals. The set of the timing control signals outputted from the display timing generator 26 includes one vertical synchronization signal, denoted by VSYNC_I, hereinafter, and one horizontal synchronization signal, denoted by HSYNC_I, hereinafter. The vertical synchronization signal VSYNC_I and the horizontal synchronization signal HSYNC_I are fed to the data latch 24 to control the latch timing and also used to control the operation timing of the scan line drive circuit 32. The state of the selector 26*b* is switched in response to the register value REG_GAM_TEST. As described later, the register value REG_GAM_TEST is set to "0" when the display controller/driver 2 is placed into the normal operation mode. The selector 26*b* selects the set of the timing control signals received from the interface unit 21 (that is, the external vertical synchronization signal VSYNC_IO and the external horizontal synchronization signal HSYNC_IO) in response to the register value REG_GAM_TEST being set to "0". When the display controller/driver 2 is placed into the test mode, on the other hand, the register value REG_GAM_TEST is set to "1". The selector 26*b* selects the set of the timing control signals received from the evaluation image display timing generator circuit 26*a* (that is, the internal vertical synchronization signal VSYNC_II and the internal horizontal synchronization signal HSYNC_II) in response to the register value REG_GAM_TEST being set to "1".

The register initial value ROM 27 and the register section 28 has the function of providing the image data generator 22 and the display timing generator 26 with register values used to control the image data generator 22 and the display timing generator 26 and also has the function of providing the brightness correction circuit 23 with the brightness correction parameter values REG_CORRECTION.

In detail, the register section 28 includes a display characteristic evaluation test mode setting register 28*a* and a brightness correction parameter setting register 28*b*. The test mode setting register 28*a* is used to hold the following four register values: REG_GAM_TEST, REG_GAM_FRAME, REG_GAM_STEP and REG_IMAGE_BIT. Here, as is described above, the register value REG_GAM_TEST is a register value indicating which of the normal operation mode and the test mode the display controller/driver 2 is placed into. The register values REG_GAM_FRAME, REG_GAM_STEP and REG_IMAGE_BIT are values used to generate the evaluation image data IMAGE_DATA_II in each frame period while the settings of the display controller/driver 2 are adjusted. Details of the register values REG_GAM_FRAME, REG_GAM_STEP and REG_IMAGE_BIT will be described later.

The register initial value ROM 27 holds initial values to be set into the test mode setting register 28*a* and the brightness correction parameter setting register 28*b* upon a power-on of the display controller/driver 2, in a nonvolatile manner. When the power of the display controller/driver 2 is set ON, the register values REG_GAM_TEST, REG_

GAM_FRAME, REG_GAM_STEP and REG_IMAGE_BIT initially stored in the register initial value ROM 27 are set into the test mode setting register 28*a* and the brightness correction parameter values REG_CORRECTION initially stored in the register initial value ROM 27 are set to the brightness correction parameter setting register 28*b*. As described later, the register initial value ROM 27 is rewritable.

Next, a description is given below of exemplary operations of the display device 10 and display controller/driver 2 thus configured.

(Normal Operation)

Figure 4:
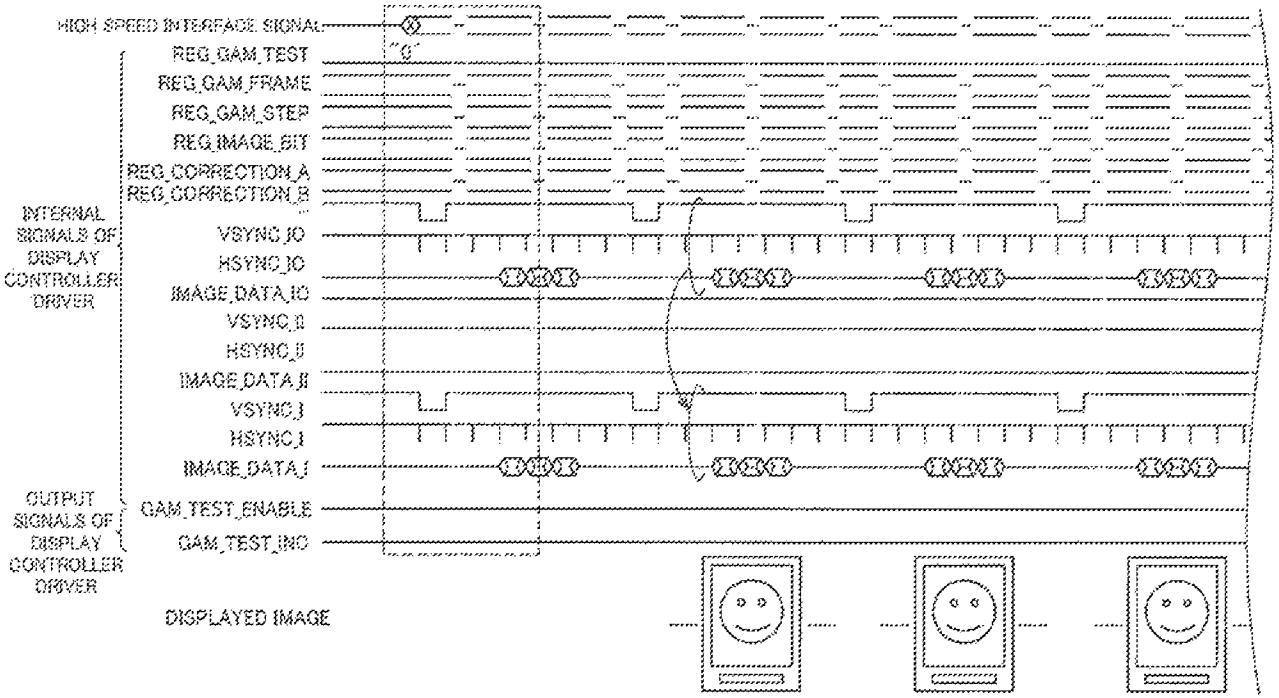
FIGS. 4 and 5 are timing charts illustrating an exemplary operation of a display controller/driver in the normal operation mode in the first embodiment.

First, a description is given of the operation when the display device 10 performs a normal operation, that is, when the display controller/driver 2 is placed into the normal operation mode. FIG. 4 is a timing chart illustrating the operation of the display controller driver 2 and FIG. 5 is an enlarged view of the portion indicated by the dotted line in FIG. 4.

When the power of the display controller/driver 2 is set ON, initial values are read out from the register initial value ROM 27 and set to the test mode setting register 28*a* and the brightness correction parameter setting register 28*b*. Since the initial value of the register value REG_GAM_TEST stored in the register initial value ROM 27 is "0", the register value REG_GAM_TEST is set to "0" as shown in FIG. 4, and the display controller/driver 2 is thereby placed into the normal operation mode. Also, the brightness correction parameter values REG_CORRECTION stored in the register initial value ROM 27 are set to the brightness correction parameter setting register 28*b* and the brightness correction circuit 23 is thereby placed into a state in which the correction calculation is performed in response to the brightness correction parameter values REG_CORRECTION set to the brightness correction parameter setting register 28*b*.

Figure 5:
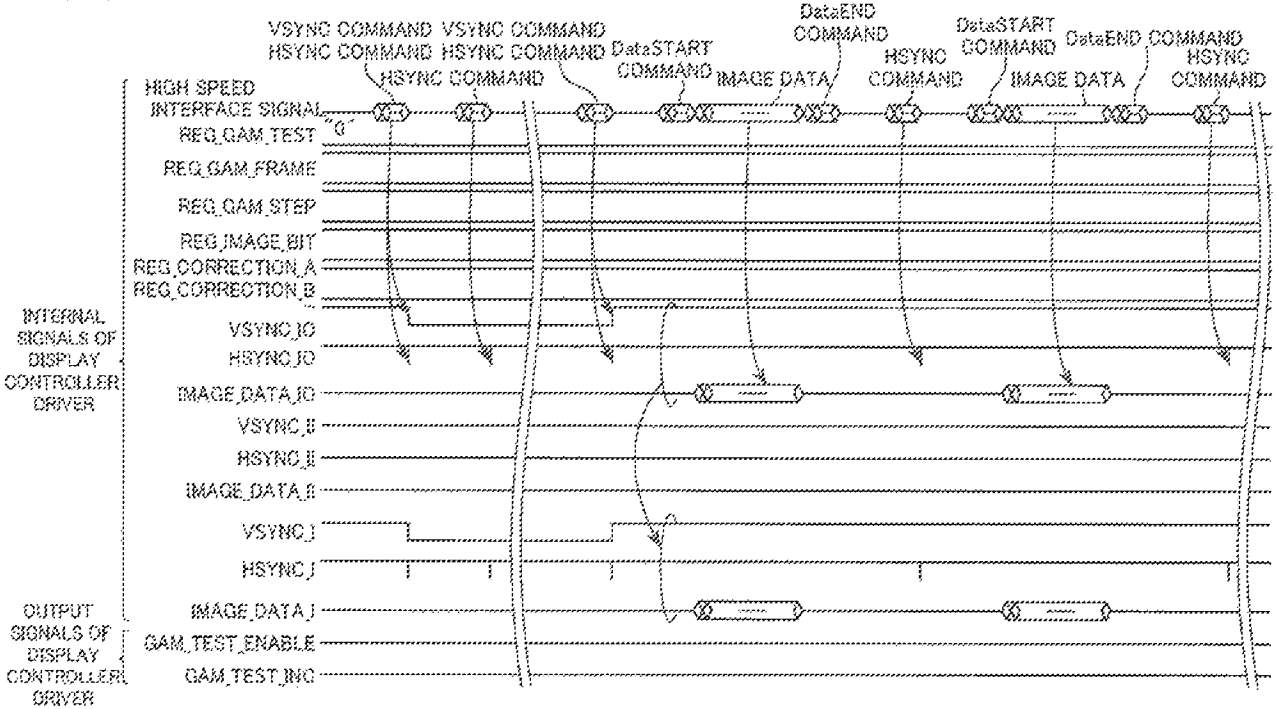

Furthermore, as shown in FIG. 5, timing control data and image data are fed from the timing controller 1 to the display controller/driver 2 by the high-speed interface signal. As described above, the timing control data include VSYNC commands used to generate the vertical synchronization signal in the display controller/driver 2, HSYNC commands used to generate the horizontal synchronization signal, data start commands each indicating a start of image data transmission and data end commands each indicating an end of the image data transmission.

The interface unit 21 of the display controller/driver 2 generates the external vertical synchronization signal VSYNC_IO in response to the VSYNC commands. The VSYNC commands include a command indicating to set the external vertical synchronization signal VSYNC_IO to the "high" level and a command indicating to set the external vertical synchronization signal VSYNC_IO to the "low" level. The external vertical synchronization signal VSYNC_IO is generated by transmitting the VSYNC commands at adequate timing so that the external vertical synchronization signal VSYNC_IO is activated at the beginning of each frame period (or each vertical synchronization period) for a predetermined time duration. It should be noted that the external vertical synchronization signal VSYNC_IO is illustrated as a low-active signal in FIG. 5.

The interface unit 21 further generates the external horizontal synchronization signal HSYNC_IO in response to the HSYNC commands. The HSYNC commands include a command indicating to set the external horizontal synchronization signal HSYNC_IO to the "high" level and a command indicating to set the external horizontal synchronization signal HSYNC_IO to the "low" level. The external horizontal synchronization signal HSYNC_IO is generated by transmitting the HSYNC commands at adequate timing so that the external horizontal synchronization signal HSYNC_IO is activated at the beginning of each horizontal synchronization period for a predetermined time duration.

When receiving a data start command, on the other hand, the interface unit 21 recognizes data subsequent to the data start command as image data and outputs the data received subsequently to receipt of the data start command as the external image data IMAGE_DATA_IO. When receiving a data end command, the interface unit 21 recognizes the completion of the transmission of the image data and stop outputting the external image data IMAGE_DATA_IO.

During this operation, in response to the register value REG_GAM_TEST being set to "0", the selector 22*b* of the image data generator 22 feeds the external image data IMAGE_DATA_IO received from the interface unit 21 to the brightness correction circuit 23. The brightness correction circuit 23 performs a correction calculation on the received external image data IMAGE_DATA_IO in response to the brightness parameter values REG_CORRECTION set to the brightness correction parameter setting register 28*b* and feeds the corrected image data to the data latch 24.

In addition, in response to the register value REG_GAM_TEST being set to "0", the selector 26*b* of the display timing generator 26 outputs the external vertical synchronization signal VSYNC_IO and external horizontal synchronization signal HSYNC_IO received from the interface unit 21 as the vertical synchronization signal VSYNC_I and horizontal synchronization signal HSYNC_I actually used in the respective circuits in the display controller/driver 2. The data latch 24 latches the corrected image data from the brightness correction circuit 23 at timing synchronous with the vertical synchronization signal VSYNC_I and horizontal synchronization signal HSYNC_I. Also, the vertical synchronization signal VSYNC_I and horizontal synchronization signal HSYNC_I are fed to the scan line drive circuit 32 of the liquid crystal display panel 3 and the scan line drive circuit 32 drives the scan lines of the display section 31 in synchronization with the vertical synchronization signal VSYNC_I and horizontal synchronization signal HSYNC_I.

The image data latched by the data latch 24 are transferred to the signal line drive circuit 25. The signal line drive circuit 25 drives the signal lines of the display section 31 in response to the received image data.

As thus described, in the normal operation, images corresponding to the image data transmitted from the timing controller 1 to the display controller/driver 2 are displayed on the display section 31 of the liquid crystal display panel 3 at timing determined depending on the timing control data transmitted from the timing controller 1 to the display controller/driver 2.

(Adjustment of Display Characteristics)

Next, a description is given of the adjustment of the display characteristics of the display device 10, which is configured as illustrated in FIG. 3. In this embodiment, the adjustment of the display characteristics of the display device 10 is achieved by adjusting the settings of the brightness correction circuit 23 of the display controller/driver 2, in other words, adjusting the brightness correction parameter values REG_CORRECTION stored in the register initial value ROM 27, which are to be set to the brightness correction parameter setting register 28*b*.

Figure 6:
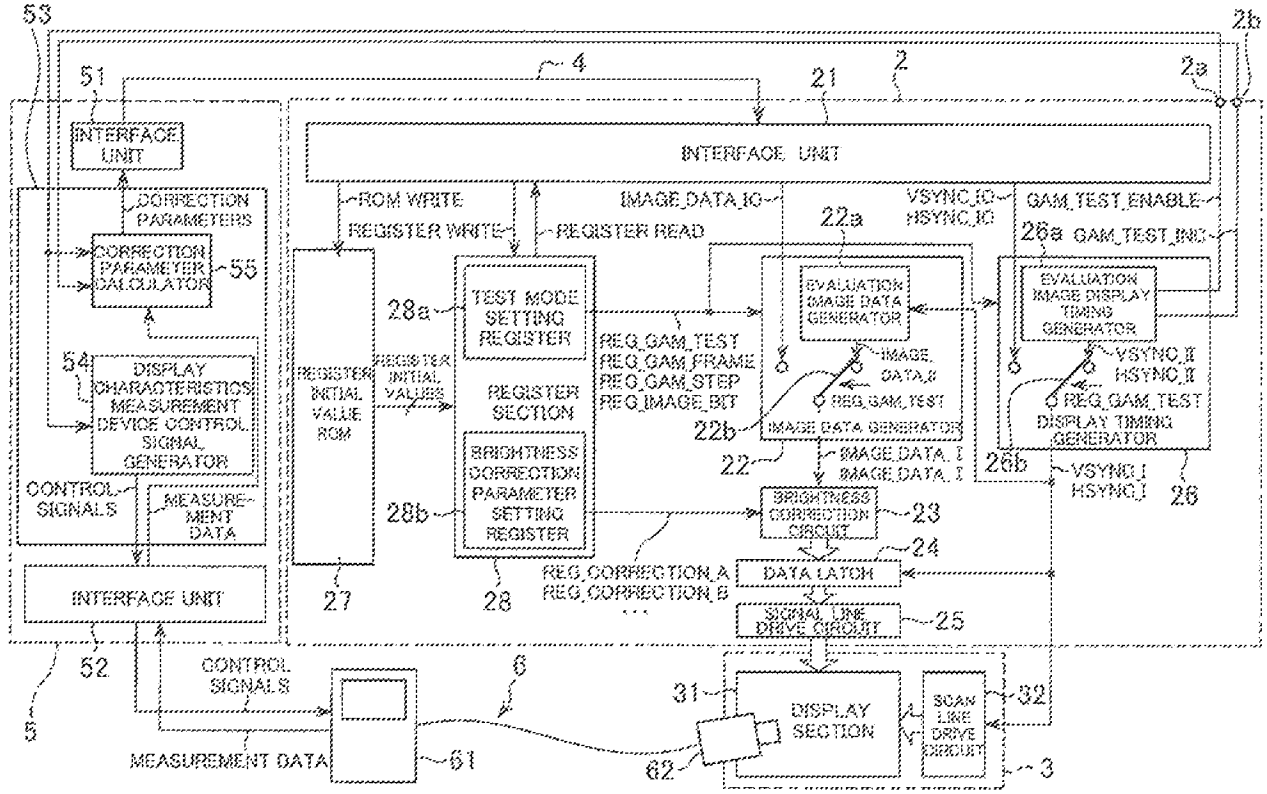
FIG. 6 is a block diagram illustrating exemplary configurations of an adjustment device and a display characteristics measurement device used for adjustment of the display characteristics of the display device (that is, adjustment of the settings of a brightness correction circuit of the display controller/driver) in the first embodiment.

When the settings of the brightness correction circuit 23 of the display controller driver 2 are adjusted, as shown in FIG. 6, an adjustment device 5 and a display characteristics measurement device 6 are used. The adjustment device 5 is connected to the high-speed data communication line 4 in place of the timing controller 1 and further connected to the external connection terminals 2*a* and 2*b* of the display controller/driver 2. This allows the adjustment device 5 to set the display controller/driver 2 via the high-speed data communication line 4 and to receive a test enable signal GAM_TEST_ENABLE and an evaluation image switching signal GAM_TEST_INC, which are outputted from the external connection terminals 2*a* and 2*b*, respectively. The display characteristics measurement device 6 is connected to the adjustment device 5. The display characteristics measurement device 6 is configured to measure the display characteristics of the display device 10. In this embodiment, the display characteristics measurement device 6 measures the image characteristics of the evaluation images displayed on the display section 31 of the liquid display panel 3.

In detail, the adjustment device 5 includes an interface unit 51 used for communications with the display controller/driver 2, an interface unit 52 used for communications with the display characteristics measurement device 6 and a correction parameter calculation device 53. The correction parameter calculation device 53 includes a display characteristics measurement device control signal generator 54 generating display characteristics measurement device control signals and a correction parameter calculator 55 calculating brightness correction parameter values REG_CORRECTION to be finally written into the register initial value ROM 27. The display characteristics measurement device control signal generator 54 and the correction parameter calculator 55 may be implemented in a form of hardware or in a form of a combination of hardware and software. For example, the display characteristics measurement device control signal generator 54 and the correction parameter calculator 55 may be implemented in a form of a circuit board on which a FPGA (field programmable gate array) or a microcomputer in mounted. Alternatively, the functions of the display characteristics measurement device control signal generator 54 and the correction parameter calculator 55 may be realized by a combination of software and a processing unit.

The display characteristics measurement device 6 includes an operation section 61 and a measurement sensor section 62. The measurement sensor section 62 includes a sensor measuring the image characteristics of an evaluation image displayed on the display section 31 of the liquid crystal display panel 3. The image characteristics to be measured include image characteristics used for adjustment of the white point and image characteristics used for adjustment of the gamma value. The chromaticity coordinates x and y defined in the xyY color system may be measured as the image characteristics used for the adjustment of the white point; instead, the color temperature of the evaluation image may be directly measured. On the other hand, the brightness of the evaluation image displayed on the display section 31 may be measured as the image characteristics used for the adjustment of the gamma value. The operation section 61 operates the measurement sensor 62 in response to the display characteristics measurement device control signals received from the adjustment device 5 and transmits measurement data indicating the measured image characteristics to the adjustment device 5. As described later, the settings of the brightness correction circuit 23 (that is, the brightness correction parameter values REG_CORRECTION) are adjusted so that the color temperature is kept constant even when the gray levels of the evaluation images are switched.

One feature of the display controller/driver 2 of the present invention is that a mode is prepared for adjusting the setting of the brightness correction circuit 23. This mode is referred to as "test mode", hereinafter. When the settings of the brightness correction circuit 23 are adjusted, the display controller/driver 2 is placed into the test mode, in which evaluation images are displayed. When placed into the test mode, the display controller/driver 2 internally generates evaluation image data IMAGE_DATA_II corresponding to the evaluation images and controls the switching timing of the evaluation images by itself. Such operation of the display controller/driver 2, in which the display controller/driver 2 itself generates the evaluation image data IMAGE_DATA_II and also controls the switching timing of the evaluation images, eliminates the need of providing the adjustment device with the function of feeding timing control data and image data to the display controller/driver 2, effectively reducing the cost of the adjustment device 5. Such advantage is remarkable especially when the display controller/driver 2 is configured to perform communications with a high-speed serial interface. It should be noted that the operation of the timing controller 1 is stopped when the settings of the brightness correction circuit 23 are adjusted.

Figure 7A:
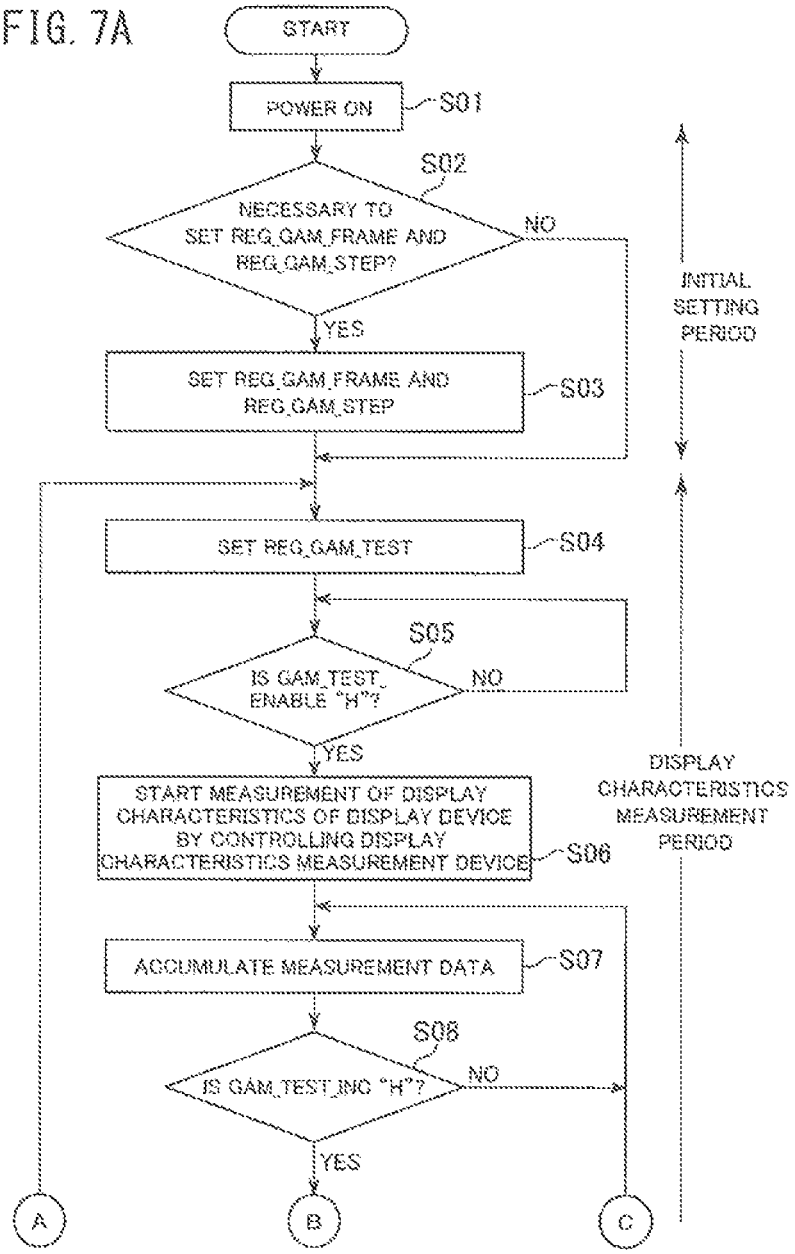
FIGS. 7A and 7B are flow charts illustrating an exemplary operation of the adjustment device in the adjustment of the display characteristics of the display device (that is, the adjustment of the settings of a brightness correction circuit of the display controller/driver) in the first embodiment.
Figure 7B:
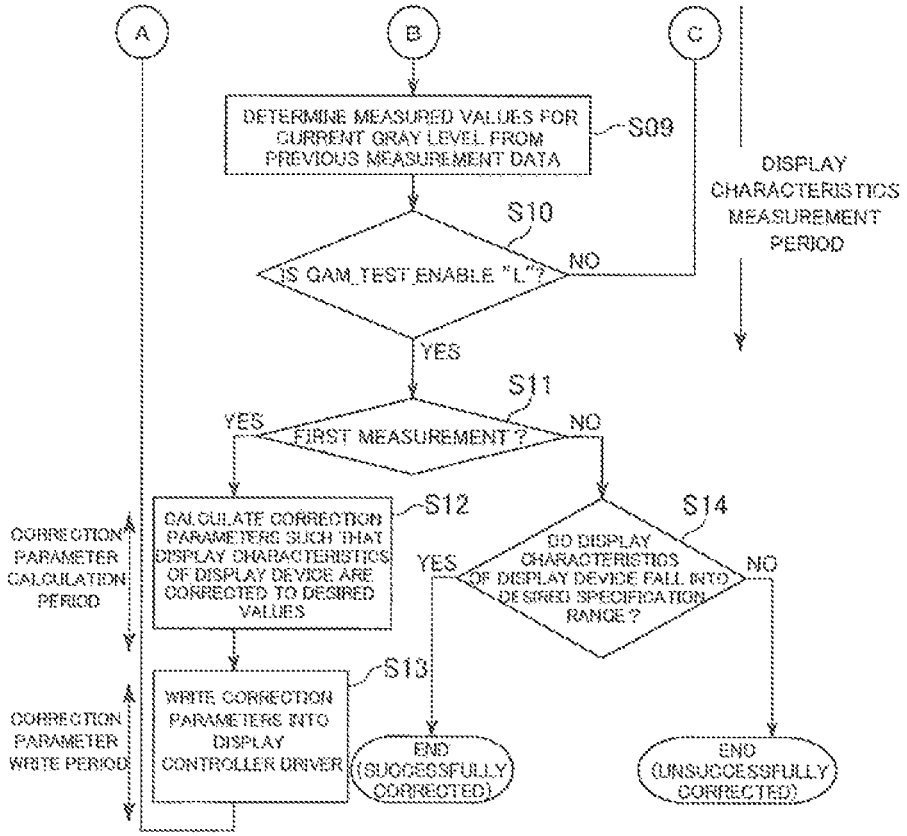
Figure 8:
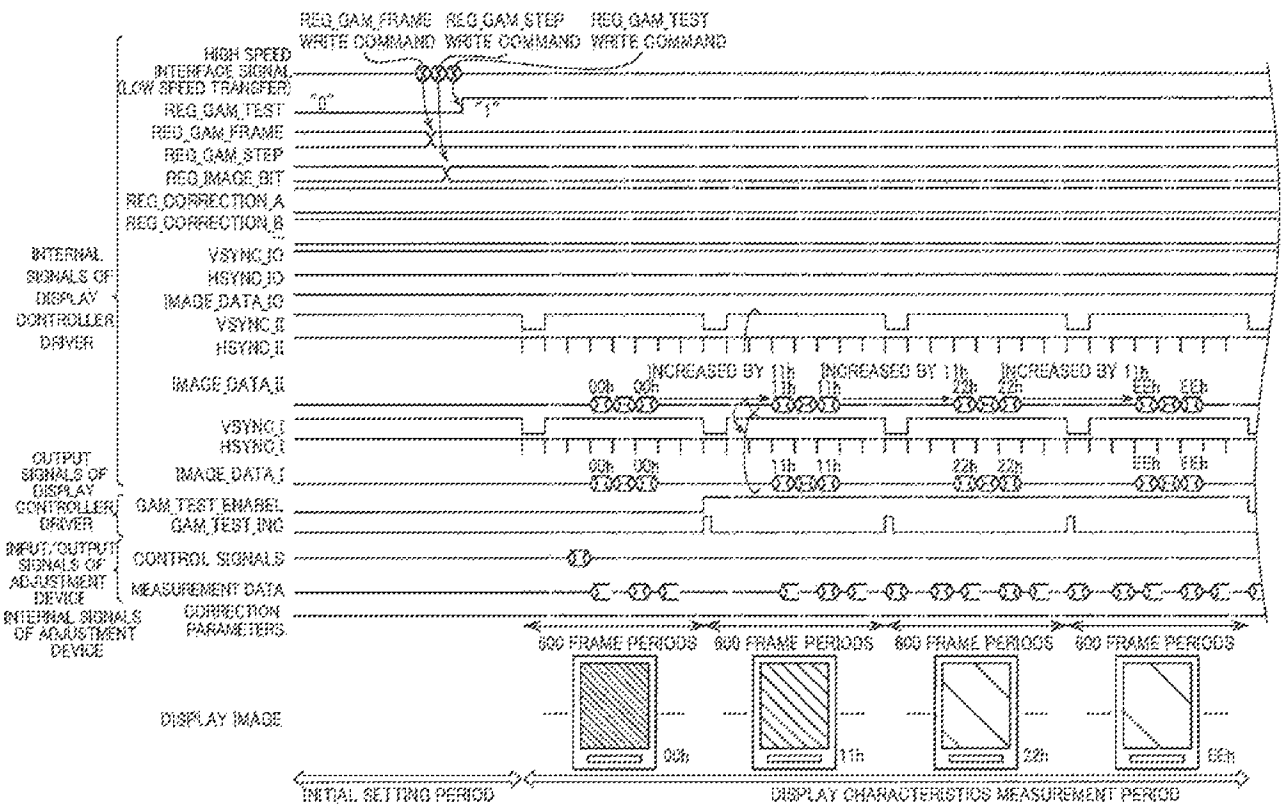
FIGS. 8 and 9 are timing charts illustrating an exemplary operation of the display controller/driver in the adjustment of the settings of a brightness correction circuit in the first embodiment.
Figure 9:
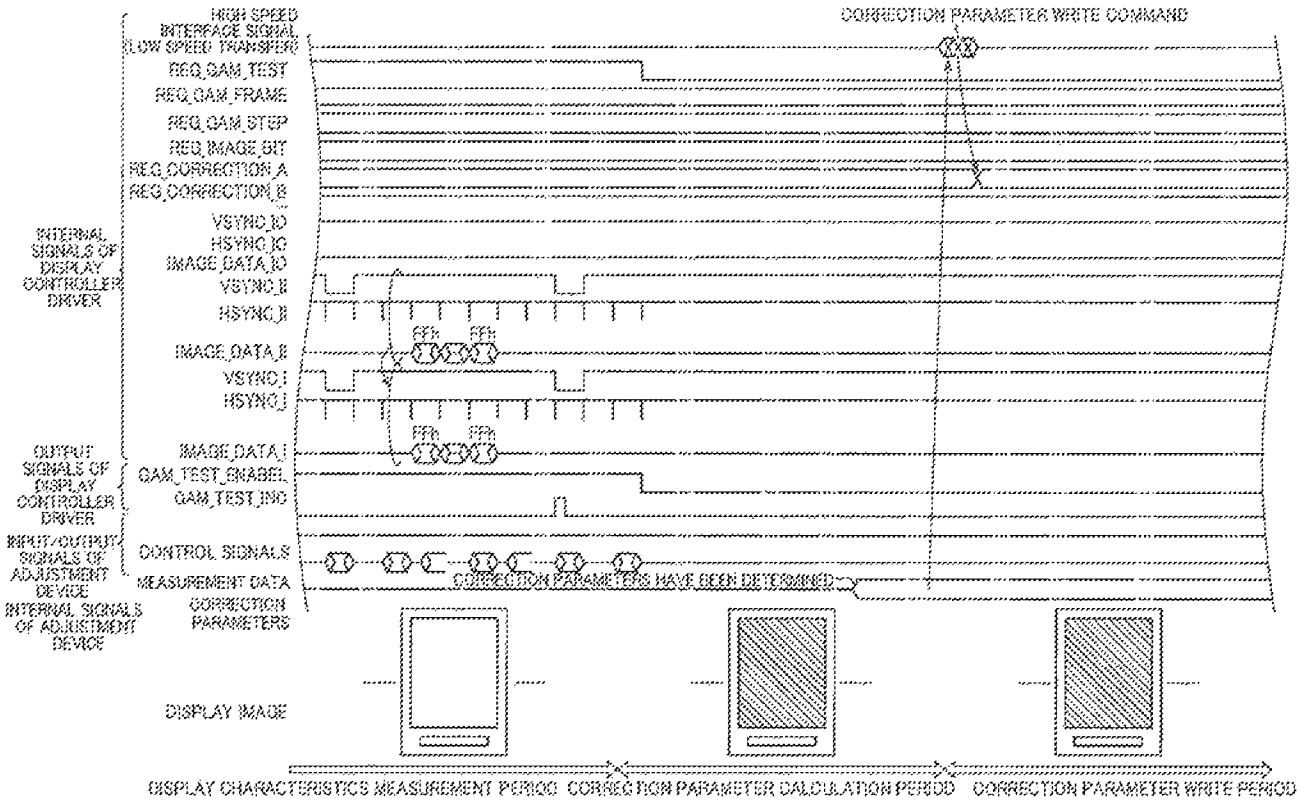

FIG. 7 is a flow chart illustrating an exemplary operation of the adjustment device 5 in the adjustment of the display characteristics of the display device 10, that is, the adjustment of the settings of the brightness correction circuit 23 of the display controller/driver 2. FIGS. 8 and 9 are, on the other hand, timing charts illustrating an exemplary operation of the display controller/driver 2 in the adjustment of the settings of the brightness correction circuit 23.

The adjustment procedure of the display characteristics of the display device 10, that is, the adjustment procedure of the settings of the brightness correction circuit 23 includes the following four periods: an initial seating period, a display characteristics measurement period, a correction parameter calculation period and a correction parameter write period. FIG. 8 illustrates an exemplary operation of the display controller/driver 2 in the initial setting period and the display characteristics measurement period, and FIG. 9 illustrates an exemplary operation of the display controller/driver 2 in the correction parameter calculation period and the correction parameter write period.

The register initial value ROM 27 of the display controller/driver 2 stores initial values of the following four register values: REG_GAM_TEST, REG_GAM_FRAME, REG_GAM_STEP and REG_IMAGE_BIT. The register value REG_GAM_TEST indicates which of the normal operation mode and the test mode the display controller/driver 2 is placed into, and the initial value of the register value REG_GAM_TEST, which is stored in the register initial value ROM 27, is "0". The register value REG_GAM_FRAME indicates the length of the period in which the evaluation image of each gray level is displayed, in units of frame periods. The register value REG_GAM_STEP indicates the increment of the gray levels in switching the evaluation images. Finally, the register value REG_IMAGE_BIT indicates the number of bits allocated to the gray level value for each color of each pixel in the image data; in this embodiment, the register value REG_IMAGE_BIT is set to "8".

Additionally, the register initial value ROM 27 stores initial values of the brightness correction parameter values REG_CORRECTION to be set to the brightness parameter setting register 28*b*. As described above, the brightness parameter values REG_CORRECTION specify the relation between the gray level values of the image data IMAGE_DATA_I inputted to the brightness correction circuit 23 and the gray level values of the image data outputted from the brightness correction circuit 23. Before the adjustment of the settings of the brightness correction circuit 23, as the initial values of the brightness correction parameter setting register 28*b*, the register initial value ROM 27 stores the brightness correction parameter values REG_CORRECTION defined so that the relation between the gray level values of the image data inputted to the brightness correction circuit 23 and those of the image data outputted form the brightness correction circuit 23 is set linear.

Referring now to FIG. 7, the power of the display controller/driver 2 is first set ON in the initial setting period (step S01). In response to the power-on of the display controller/driver 2, the initial values of the register values REG_GAM_TEST, REG_GAM_FRAME, REG_GAM_STEP and REG_IMAGE_BIT are read out from the register initial value ROM 27 and set to the test mode setting register 28*a*. In addition, the initial values of the brightness parameter values REG_CORRECTION are set to the brightness correction parameter setting register 28*b*.

In the meantime, the correction parameter calculation device 53 of the adjustment device 5 determines whether it is necessary to externally set the register value REG_GAM_FRAME and/or the register value REG_GAM_STEP (step S02). When it is necessary to set the register value REG_GAM_FRAME of the test mode setting register 28*a* to a different value from the initial value stored in advance in the register initial value ROM 27, the correction parameter calculation device 53 of the adjustment device 5 transmits a REG_GAM_FRAME write command to the display controller/driver 2 via the high-speed data communication line 4 (step S03). The REG_GAM_FRAME write command describes a register value REG_GAM_FRAME to be set to the test mode setting register 28*a*. When receiving the REG_GAM_FRAME write command, the interface unit 21 of the display controller/driver 2 sets the register value REG_GAM_FRAME of the test mode setting register 28*a* to the value described in the REG_GAM_FRAME write command. Similarly, when it is necessary to set the register value REG_GAM_STEP of the test mode setting register 28*a* to a different value from the initial value stored in advance in the register initial value ROM 27, the correction parameter calculation device 53 of the adjustment device 5 transmits a REG_GAM_STEP write command to the display controller/driver 2 via the high-speed data communication line 4 (step S03). The REG_GAM_STEP write command describes the register value REG_GAM_STEP to be set to the test mode setting register 28*a*. When receiving the REG_GAM_STEP write command, the interface unit 21 of the display controller/driver 2 sets the register value REG_GAM_STEP of the test mode setting register 28*a* to the value described in the REG_GAM_STEP write command. Note that FIG. 8 illustrates the operation in the case when both of the REG_GAM_FRAME write command and the REG_GAM_STEP write command are transmitted to the display controller/driver 2.

This is followed by starting the display characteristics measurement period. In the display characteristics measurement period, the correction parameter calculation device 53 of the adjustment device 5 first sets the register value REG_GAM_TEST of the test mode setting register 28*a* to a specific value, more specifically, to "1" (step S04). As a result of this operation, the display controller/driver 2 is placed into the test mode.

In response to the register value REG_GAM_TEST of the test mode setting register 28*a* being set to "1", the evaluation image data generator circuit 22*a* of the image data generator 22 is activated and starts generating the evaluation image data IMAGE_DATA_II. In addition, the selector 22*b* selects the evaluation image data IMAGE_DATA_II as the image data IMAGE_DATA_I to be fed to the brightness correction circuit 23.

Furthermore, the evaluation image display timing generator circuit 26*a* of the display timing generator 26 is activated in response to the register value REG_GAM_TEST being set to "1", and starts generating the internal vertical synchronization signal VSYNC_II and the internal horizontal synchronization signal HSYNC_II. In addition, the selector 26*b* selects the internal vertical synchronization signal VSYNC_II and the internal horizontal synchronization signal HSYNC_II, which are generated by the evaluation image display timing generator circuit 26*a*. As a result, as shown in FIG. 8, the internal vertical synchronization signal VSYNC_II and the internal horizontal synchronization signal HSYNC_II are outputted from the display timing generator 26 as the vertical synchronization signal VSYNC_I and the internal horizontal synchronization signal HSYNC_I, which are actually used in the respective circuits in the display controller driver 2.

The evaluation image data generator circuit 22*a* sequentially switches the evaluation image data IMAGE_DATA_II in synchronization with the vertical synchronization signal VSYNC_I and the horizontal synchronization signal HSYNC_I, that is, in synchronization with the internal vertical synchronization signal VSYNC_II and the internal horizontal synchronization signal HSYNC_II, which are generated by the evaluation image display timing generator circuit 26*a*.

FIGS. 8 and 9 illustrate a specific example of the switching of the evaluation image data IMAGE_DATA_II, that is, the switching of the evaluation image displayed on the display section 31 at the bottom. The evaluation image data IMAGE_DATA_II are generated so that the gray levels of red, green and blue of every pixel are a constant value in each evaluation image. Additionally, the evaluation image data IMAGE_DATA_II are generated so that the gray levels are changed by the value specified by the register value REG_GAM_STEP every a predetermined number of frame periods, the predetermined number specified by the register value REG_GAM_FRAME. FIGS. 8 and 9 illustrate the switching of the evaluation image in the case when the register value REG_GAM_FRAME is 600 and the register value REG_GAM_STEP is 11h.

First, immediately after the register value REG_GAM_TEST is set to "1", the evaluation image data IMAGE_DATA_II are generated so that the gray levels of red, green and blue are all 00h for every pixel in the evaluation image displayed on the display section 31. The evaluation image corresponding to the evaluation image data IMAGE_DATA_II in which the gray levels of red, green and blue are all specified as 00h is displayed for the number of frame periods specified by the register value REG_GAM_FRAME (that is, for 600 frame periods).

Subsequently, an evaluation image corresponding to evaluation image data IMAGE_DATA_II in which the gray levels of red, green and blue are increased by the value specified by the register value REG_GAM_STEP (that is, 11h) is displayed for 600 frame periods. In the same way, the evaluation images are switched by sequentially increasing the gray levels of the red, green and blue of every pixel. The above-described switching of the evaluation images is continued until the display of an evaluation image corresponding to evaluation image data IMAGE_DATA_II in which the gray levels of red, green and blue are all specified as $2^{REG_IMAGE_BIT}-1$ (in this embodiment, "FFh") is completed.

It would be easily understood by a person skilled in the art that the above-described switching of the evaluation image data IMAGE_DATA_II can be realized by the evaluation image data generator circuit 22*a*, which receives the register values REG_GAM_FRAME, REG_GAM_STEP, REG_IMAGE_BIT and the vertical synchronization signal VSYNC_I.

The brightness correction circuit 23 feeds image data corresponding to the received image data IMAGE_DATA_I (that is, the evaluation image data IMAGE_DATA_II) to the signal line drive circuit 25. In this operation, the brightness correction circuit 23 feeds the image data IMAGE_DATA_I to the signal line drive circuit 25 as they are, since the brightness correction parameter values REG_CORRECTION are initially fed from the brightness correction parameter setting register 28*b* to the brightness correction circuit 23 so that the relation between the gray levels of image data inputted to the brightness correction circuit 23 and those of image data outputted from the brightness correction circuit 23 is set linear before the adjustment of the settings of the brightness correction circuit 23. The signal line drive circuit 25 drives the signal lines of the display section 31 of the liquid crystal display panel 3 in response to the image data received from the brightness correction circuit 23. As a result, the evaluation images are displayed on the display section 31.

The evaluation image display timing generator circuit 26*a* feeds the test enable signal GAM_TEST_ENABLE and the evaluation image switching signal GAM_TEST_INC to the adjustment device 5 in parallel with the display of the evaluation images on the display section 31. Here, the test enable signal GAM_TEST_ENABLE is a control signal indicating the start of the display of the evaluation image on the display section 31, and the evaluation image switching signal GAM_TEST_INC is a control signal indicating that the evaluation image is about to be switched.

In detail, in response to the register value REG_GAM_TEST of the test mode setting register 28*a* being set to "1", the evaluation image display timing generator circuit 26*a* activates the test enable signal GAM_TEST_ENABLE and starts supplying the evaluation image switching signal GAM_TEST_INC, as illustrated in FIG. 8. The evaluation image switching signal GAM_TEST_INC is activated for a predetermined time duration immediately before the switching of the gray levels of the evaluation images. In FIG. 8, the test enable signal GAM_TEST_ENABLE and the evaluation image switching signal GAM_TEST_INC are both illustrated as a high-active signal.

When the test enable signal GAM_TEST_ENABLE is then activated (step S05), as illustrated in FIG. 7, the adjustment device 5 operates the display characteristics measurement device 6 to start a measurement of the display characteristics of the display device 10, that is, the image characteristics of the evaluation image displayed on the display section 31 (steps S06 to S11). In detail, the display characteristics measurement device control signal generator 54 and the correction parameter calculator 55 are activated in response to the activation of the test enable signal GAM_TEST_ENABLE. The display characteristics measurement device control signal generator 54 supplies the display characteristics measurement device control signals to the display characteristics measurement device 6 via the interface unit 52, and thereby causes the display characteristics measurement device 6 to start the measurement of the image characteristics of the evaluation image displayed on the display section 31 (step S06).

The display characteristics measurement device 6 starts the measurement in response to the display characteristics measurement device control signals received from the adjustment device 5, and continuously measures the image characteristics of the evaluation image displayed on the display section 31. The image characteristics to be measured include image characteristics used for adjustment of the white point and image characteristics used for adjustment of the gamma value. In one embodiment, the chromaticity coordinates x and y defined in the xyY color system may be measured as the image characteristics used for adjustment of the white point. Alternatively, the color temperature of each evaluation image may be directly measured. Also, the brightness of each evaluation image displayed on the display section 31 may be measured as the image characteristics used for adjustment of the gamma value. The display characteristics measurement device 6 sequentially transmits the measurement data of the image characteristics of the evaluation images to the adjustment device 5.

The measurement data transmitted from the display characteristics measurement device 6 to the adjustment device 5 are stored in the correction parameter calculator 55 via the interface unit 52 (step S07). The correction parameter calculator 55 stores the measurement data transmitted to the adjustment device 5 so that the measurement data are correlated with the gray level of the evaluation image.

During this operation, the correction parameter calculator 55 recognizes the switching of the gray levels of the evaluation images by detecting the activation of the evaluation image switching signal GAM_TEST_INC (step S07). When the evaluation image switching signal GAM_TEST_INC is activated, the correction parameter calculator 55 determines the measurement result for the gray level immediately before the switching, on the basis of the measurement data obtained before the switching of the gray level (step S08). In one example, the measurement result for each gray level may be determined as the measurement data obtained immediately before the evaluation image switching signal GAM_TEST_INC is deactivated (that is, set to the low level) after the activation of the evaluation image switching signal GAM_TEST_INC. The correction parameter calculator 55 then accumulates measurement data for the next gray level.

The above-described operation is repeatedly performed while the test enable signal GAM_TEST_ENABLE is being activated (step S10).

After the display of all the evaluation images is completed, the evaluation image display timing generator circuit 26*a* of the display controller/driver 2 deactivates the test enable signal GAM_TEST_ENABLE, that is, sets the test enable signal GAM_TEST_ENABLE to the low level (step S10). In response to the deactivation of the test enable signal GAM_TEST_ENABLE, the display characteristics measurement device control signal generator 54 stops the measurement of the image characteristics of the evaluation image displayed on the display section 31 by transmitting the display characteristics measurement device control signals to the display characteristics measurement device 6 via the interface unit 52. This terminates the display characteristics measurement period.

After the first measurement of the display characteristics of the display device 10 is completed (step S11), the correction parameter calculation period is started. In the correction parameter calculation period, the correction parameter calculator 55 calculates the brightness correction parameter values REG_CORRECTION from the measured display characteristics of the display device 10, that is, the image characteristics of the evaluation image displayed on the display section 31 so that desired display characteristics are achieved (step S12).

After the calculation of the brightness correction parameter values REG_CORRECTION is completed, the correction parameter write period starts. In the correction parameter write period, the brightness correction parameter values REG_CORRECTION calculated at step S12 are transmitted to the display controller/driver 2 via the interface unit 51 (step S13) and written into the register initial value ROM 27 and the brightness correction parameter setting register 28*b*. As shown in FIG. 9, the write of the brightness correction parameter values REG_CORRECTION is achieved by transmitting a correction parameter write command to the display controller/driver 2. The correction parameter write command describes the brightness correction parameter values REG_CORRECTION to be written. When receiving the correction parameter write command, the interface unit 21 of the display controller/driver 2 writes the brightness correction parameter values REG_CORRECTION described in the correction parameter write command into the register initial value ROM 27 and the brightness correction parameter setting register 28*b*.

This is followed by measuring the display characteristics of the display device 10 in the same way again (steps S04 to S11). In this operation, the brightness correction circuit 23 performs the correction calculation on the received image data IMAGE_DATA_I (that is, the evaluation image data IMAGE_DATA_II) in response to the brightness correction parameter values REG_CORRECTION set to the brightness correction parameter setting register 28*b*, and the evaluation images are displayed on the display section 31 in response to the image data obtained by the correction calculation. Furthermore, it is checked from the result of the second measurement whether the display characteristics of the display device 10 fall in a desired range (step S14). This completes the procedure.

The above-described adjustment method in the first embodiment allows adjusting the display characteristics of the display device 10 with the cost-reduced adjustment device 5. Is should be especially noted that the evaluation images displayed on the display section 31 can be switched only by setting the register value REG_GAM_TEST of the test mode setting register 28*a* (more specifically, only by getting the register value REG_GAM_TEST to "1") in this embodiment. This result from the fact that the display controller/driver 2 has the function of automatically generating image data corresponding to evaluation images and the timing control signals controlling the display timing of the evaluation images (for example, the vertical synchronization signal and the horizontal synchronization signal) and thereby sequentially displaying the evaluation images on the display section 31. In general, register setting does not require high-speed signal transmission. Accordingly, the provision of the function of sequentially switching evaluation images only in response to register setting to the display controller/driver 2 effectively leads to various advantages, such as a reduction in the cost and an improvement in the design easiness.

Second Embodiment

Figure 10:
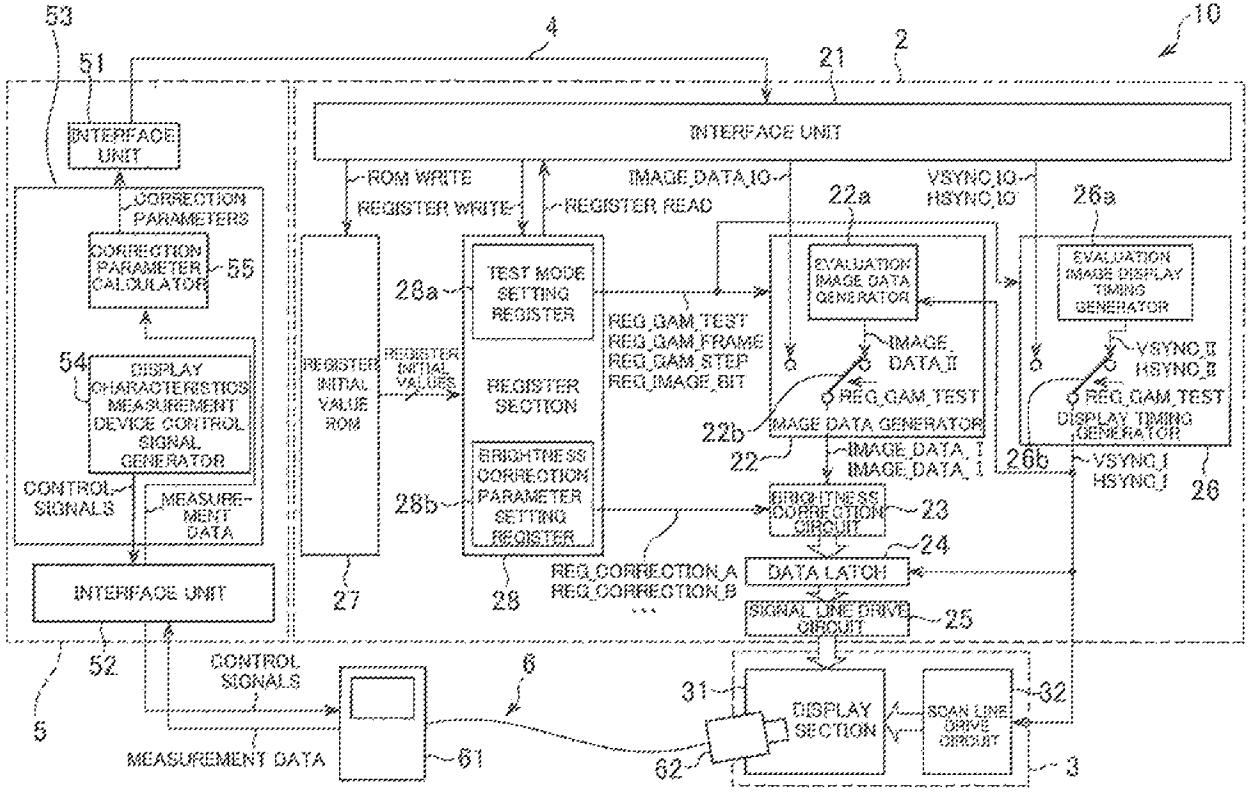
FIG. 10 is a block diagram illustrating an exemplary configuration of a display controller/driver in a second embodiment of the present invention.

FIG. 10 is a block diagram illustrating an exemplary configuration of the display controller/driver 2 in a second embodiment of the present invention. In the second embodiment, the function of feeding the test enable signal GAM_TEST_ENABLE and the evaluation image switching signal GAM_TEST_INC to the adjustment device 5 is removed from the display controller/driver 2. This effectively reduces the number of communication lines connected between the display controller/driver 2 and the adjustment device 5. In the configuration in which the display characteristics of the display device 10 are adjusted with the adjustment device 5 externally connected to the display device 10, it is desirable that the number of the communication lines connected between the display controller/driver 2 and the adjustment device 5 is reduced in view of the cost and the interconnection integration.

The operation of the display controller/driver 2 in the second embodiment is the same as that in the first embodiment except for that the display controller/driver 2 does not feed the test enable signal GAM_TEST_ENABLE and the evaluation image switching signal GAM_TEST_INC to the adjustment device 5. When the register value REG_GAM_TEST of the test mode setting register 28*a* is set to "1", the display controller/driver 2 automatically generates image data corresponding to evaluation images and timing control signals controlling the display timing of the evaluation images (for example, the vertical synchronization signal and the horizontal synchronization signal) and thereby sequentially displays the evaluation images on the display section 31.

It should be noted that, in the second embodiment, in which the test enable signal GAM_TEST_ENABLE and the evaluation image switching signal GAM_TES_INC are not outputted from the display controller/driver 2, the adjustment device 5 operates asynchronously with the display controller/driver 2. Accordingly, the operation of the adjustment device 5 is modified in this embodiment so that the adjustment device 5 detects the start of the measurement, the end of the measurement, and the switching of the gray levels of the evaluation images on the basis of the measurement result of the image characteristics of the evaluation images displayed on the display section 31. The adjustment device 5 analyses the measurement data sequentially transmitted from the display characteristics measurement device 6 and thereby determines the measurement values of the image characteristics measured for the evaluation image of each gray level.

One issue is that the current gray level of the evaluation image is not informed to the adjustment device 5 from the display controller/driver 2. In order to address this issue, the adjustment device 5 detects the switching of the evaluation images by monitoring the changes in the measurement data of the image characteristics (for example, the difference or change ratio of the measured values of the two measurement data obtained at different timings). Furthermore, the adjustment device 5 calculates the number m of the evaluation images displayed on the display section 31 from the allowed maximum value of the gray levels and the increment of the gray level in the switching of the evaluation images. It should be noted that the allowed maximum value of the gray levels and the increment of the gray level in the switching of the evaluation images are both known values, since the allowed maximum value of the gray level can be calculated as $2^{REG_IMAGE_BIT}-1$ on the basis of the register value REG_IMAGE_BIT, and the increment of the gray level in the switching of the evaluation images has been set to the display controller/driver 2 in the form of the register value REG_GAM_STEP. After obtaining the measurement data of the respective image characteristics of the m evaluation images, the adjustment device 5 can determine the association of the gray levels of the evaluation images displayed on the display section 31 with the measurement data of the image characteristics of the evaluation images, by sorting the measurement data in the order of the measured value of the brightness of the image indicated in the measurement data.

In the following, a description is given of the adjustment of the display characteristics of the display device 10, that is, the adjustment of the settings of the brightness correction circuit 23 of the display controller/drive 2 in the second embodiment.

Figure 11A:
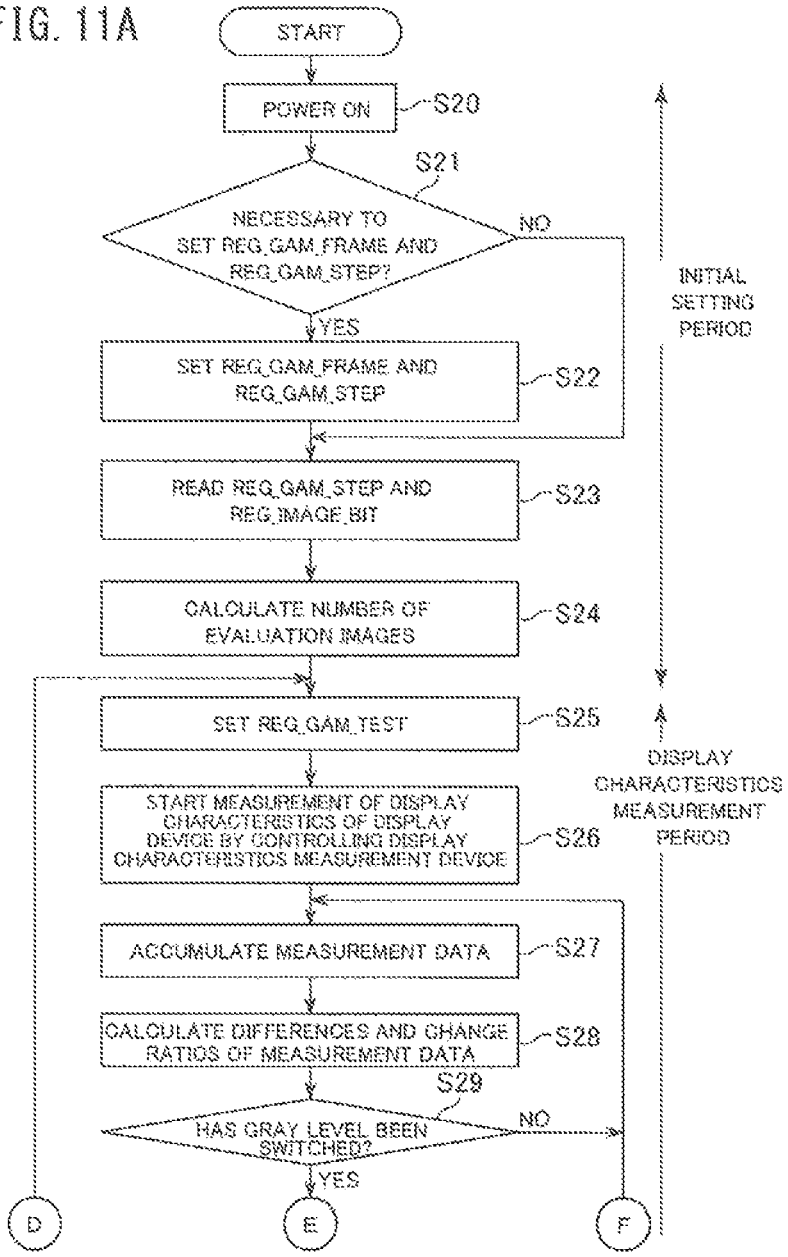
FIGS. 11A and 11B are flow charts illustrating an exemplary operation of the adjustment device in the adjustment of the display characteristics of the display device (that is, the adjustment of the settings of a brightness correction circuit of the display controller/driver) in the second embodiment.
Figure 11B:
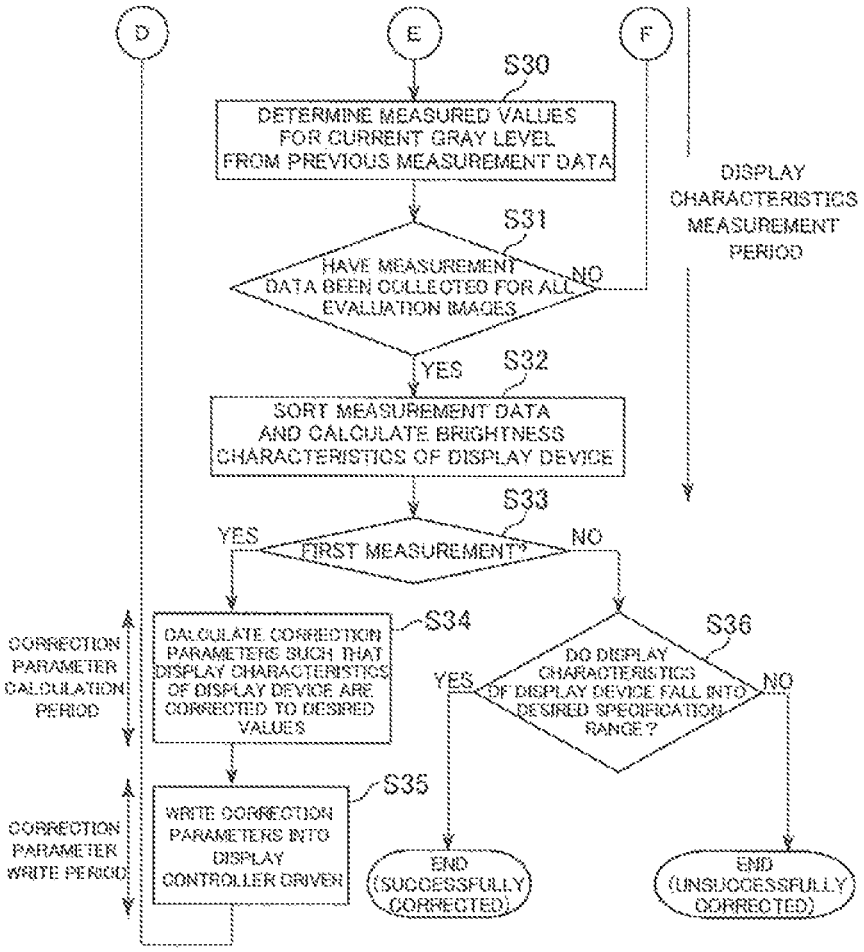
Figure 12:
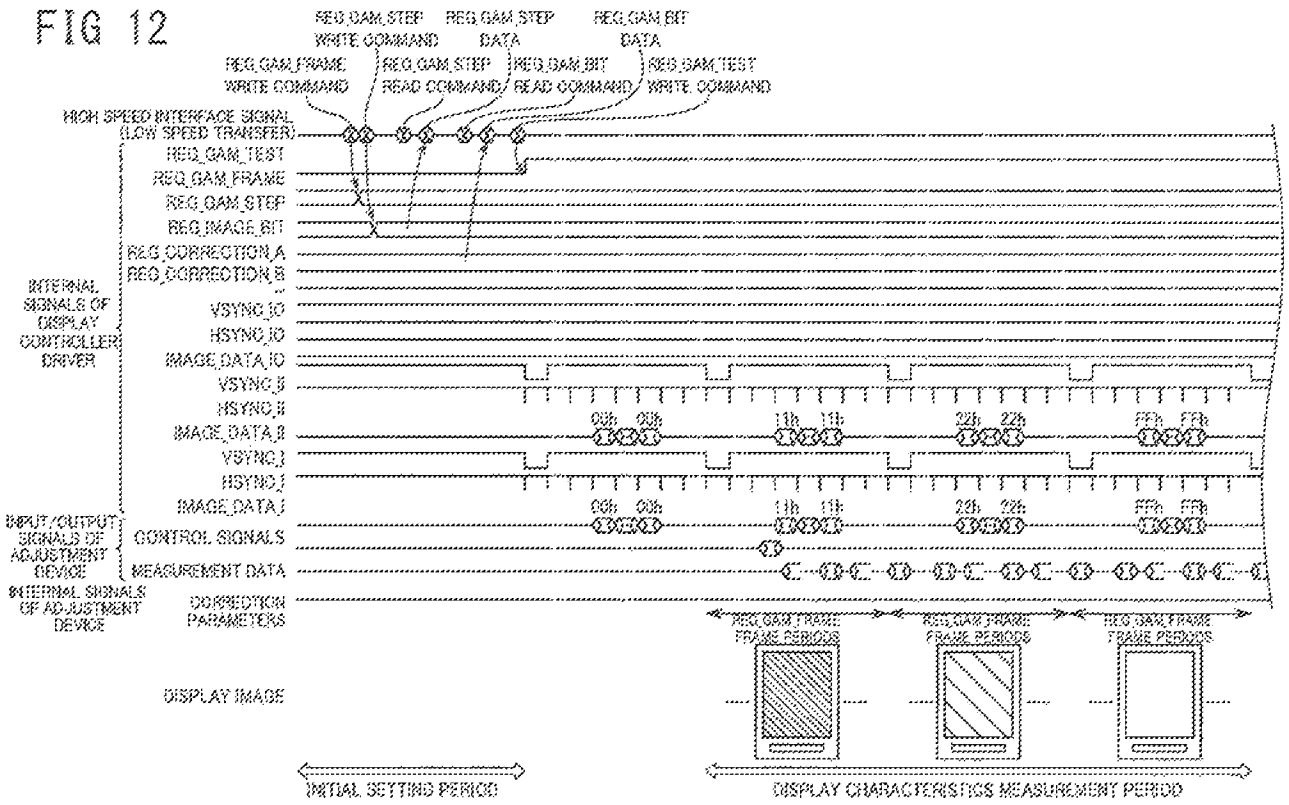
FIGS. 12 and 13 are timing charts illustrating an exemplary operation of the display controller/driver in the adjustment of the settings of a brightness correction circuit in the second embodiment.
Figure 13:
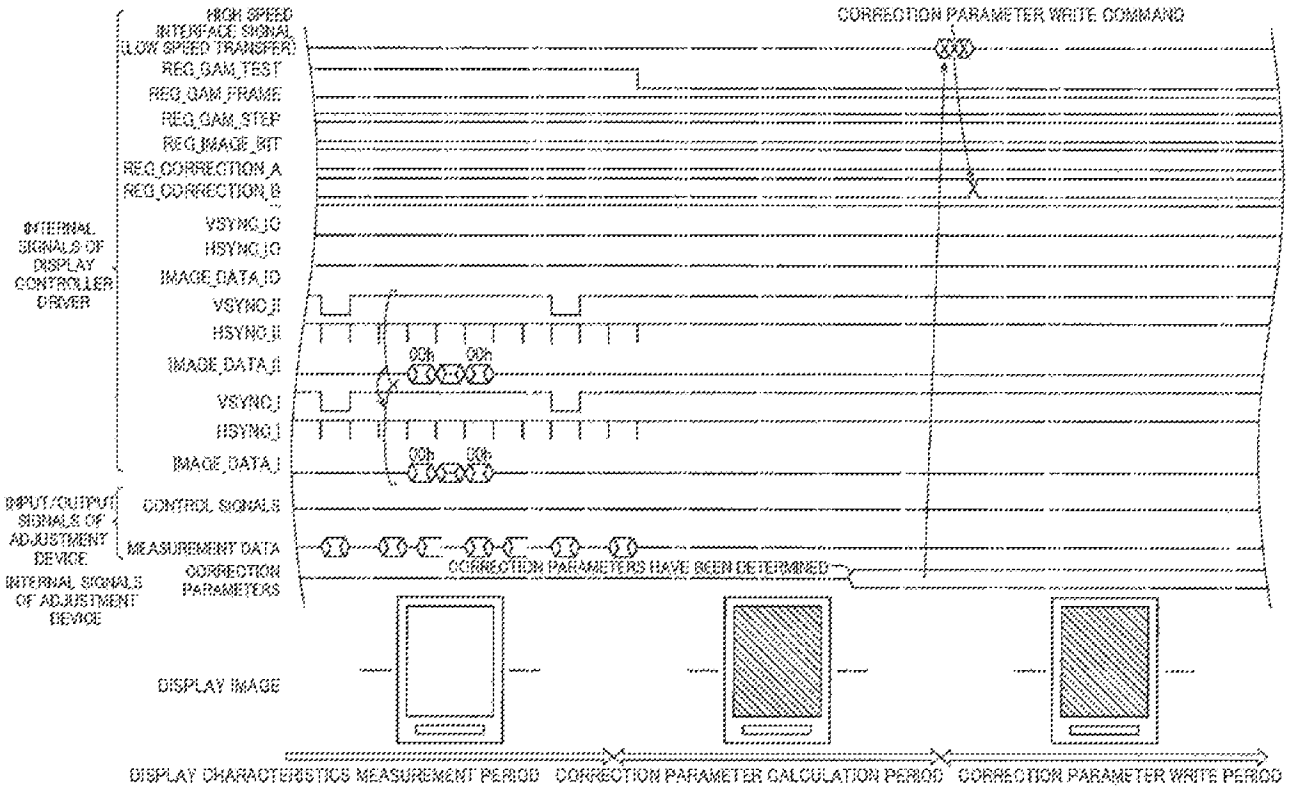

FIG. 11 is a flow chart illustrating an exemplary operation of the adjustment device 5 in the adjustment of the display characteristics of the display device 10, that is, the adjustment of the settings of the brightness correction circuit 23 of the display controller/driver 2, and FIGS. 12 and 13 are timing charts illustrating an exemplary operation of the display controller/driver 2 in the adjustment of the settings of the brightness correction circuit 23. Here, FIG. 12 illustrates the operation of the display controller driver 2 in the initial setting period and the display characteristics measurement period, and FIG. 13 illustrates the operation of the display controller driver 2 in the correction parameter calculation period and the correction parameter write period.

Referring now to FIG. 11, in the initial setting period, the power of the display controller/driver 2 is set ON (step S20). In response to the power-on of the display controller/driver 2, the initial values of the register values REG_GAM_TEST, REG_GAM_FRAME, REG_GAM_STEP and REG_IMAGE_BIT are read out from the register initial value ROM 27 and set to the test mode setting register 28*a*. In addition, the initial values of the brightness correction parameter values REG_CORRECTION are set to the brightness correction parameter setting register 28*b*.

In the meantime, the correction parameter calculation device 53 of the adjustment device 5 determines whether it is necessary to externally set the register value REG_GAM_FRAME and/or the register value REG_GAM_STEP (step S21). When it is necessary to set the register value REG_GAM_FRAME of the test mode setting register 28*a* to a different value from the initial value stored in advance in the register initial value ROM 27, the correction parameter calculation device 53 of the adjustment device 5 transmits a REG_GAM_FRAME write command to the display controller/driver 2, to set the register value REG_GAM_FRAME of the test mode setting register 28*a* to a desired value (step S22). Similarly, when it is necessary to set the register value REG_GAM_STEP of the test mode setting register 28*a* to a different value from the initial value stored in advance in the register initial value ROM 27, the correction parameter calculation device 53 of the adjustment device 5 transmits a REG_GAM_STEP write command to the display controller/driver 2 to set the register value REG_GAM_SETP of the test mode setting register 28*a* to a desired value (step S22). Note that FIG. 12 illustrates the operation in the case when both of the REG_GAM_FRAME write command and the REG_GAM_STEP write command are transmitted to the display controller/driver 2.

This is followed by reading out the register values REG_GAM_STEP and REG_IMAGE_BIT from the teat mode setting register 28*a* (step S23). In detail, as illustrated in FIG. 12, the correction parameter calculator 55 of the adjustment device 5 transmits a REG_GAM_STEP read command to the display controller/driver 2. In response to the REG_GAM_STEP read command, the interface unit 21 of the display controller/driver 2 reads out the register value REG_GAM_STEP from the test mode setting register 28*a* and transmits the register value REG_GAM_STEP to the adjustment device 5. Furthermore, the correction parameter calculator 55 transmits a REG_IMAGE_BIT read command to the display controller/driver 2. In response to the REG_IMAGE_BIT read command, the interface unit 21 of the display controller/driver 2 reads out the register value REG_IMAGE_BIT from the test mode setting register 28*a* and transmits the register value REG_IMAGE_BIT to the adjustment device 5.

It should be noted that the reading of the resister values REG_GAM_STEP and REG_IMAGE_BIT is not necessary when the adjustment device 5 already knows the register values REG_GAM_STEP and REG_IMAGE_BIT.

This is followed by starting the display characteristics measurement period. In the display characteristics measurement period, the correction parameter calculation device 53 of the adjustment device 5 sets the register value REG_GAM_TEST of the test mode setting register 28*a* to "1" (step S25). As a result of this operation, the display controller/driver 2 is placed into the test mode. The setting of the register value REG_GAM_TEST is achieved by transmitting a REG_GAM_TEST command to the display controller/driver 2.

In response to the register value REG_GAM_TEST of the test mode setting register 28*a* being set to "1", the display controller/driver 2 starts sequentially displaying evaluation images on the display section 31, similarly to the first embodiment. As described above, the gray levels of the evaluation images are sequentially switched.

After transmitting the REG_GAM_TEST write command to the display controller/driver 2, the adjustment device 5 starts a measurement of the display characteristics of the display device 5, that is, the image characteristics of the evaluation images displayed on the display section 31 at appropriate timing (steps S26 to S31). In detail, the display characteristics measurement device control signal generator 54 of the adjustment device 5 supplies the display characteristics measurement device control signals to the display characteristics measurement device 6 via the interface unit 52, and thereby causes the display characteristics measurement device 6 to start the measurement of the image characteristics of the evaluation image displayed on the display section 31 (step S26).

The display characteristics measurement device 6 starts the measurement in response to the display characteristics measurement device control signals received from the adjustment device 5, and continuously measures the image characteristics of the evaluation image displayed on the display section 31. The display characteristics measurement device 6 sequentially transmits the measurement data of the image characteristics of the evaluation images to the adjustment device 5.

The measurement data transmitted from the display characteristics measurement device 6 to the adjustment device 5 are stored in the correction parameter calculator 55 via the interface unit 52 (step S27).

During this operation, the differences or change ratios of the measurement data of the image characteristics are calculated (step S28), and the switching of the evaluation images is detected from the calculated differences or change ratios.

When detecting switching in the gray level of the evaluation image, on the basis of the measurement data obtained before the switching of the gray levels, the correction parameter calculator 55 determines the measurement result for the gray level immediately before the switching (step S30). The correction parameter calculator 55 then accumulates measurement data for the next gray level.

The above-described operation is repeatedly performed until the measurement data are completely collected for all the evaluation images, the number of which is calculated at step S24 (step S31).

After the collection of the measurement data is completed for all the evaluation images, the correction parameter calculator 55 determines the association of the gray levels with the measurement data of the image characteristics of the evaluation images displayed on the display section 31 by sorting the measurement data in the order of the measured value of the image brightness indicated in the measurement data (step S32).

Figure 14:
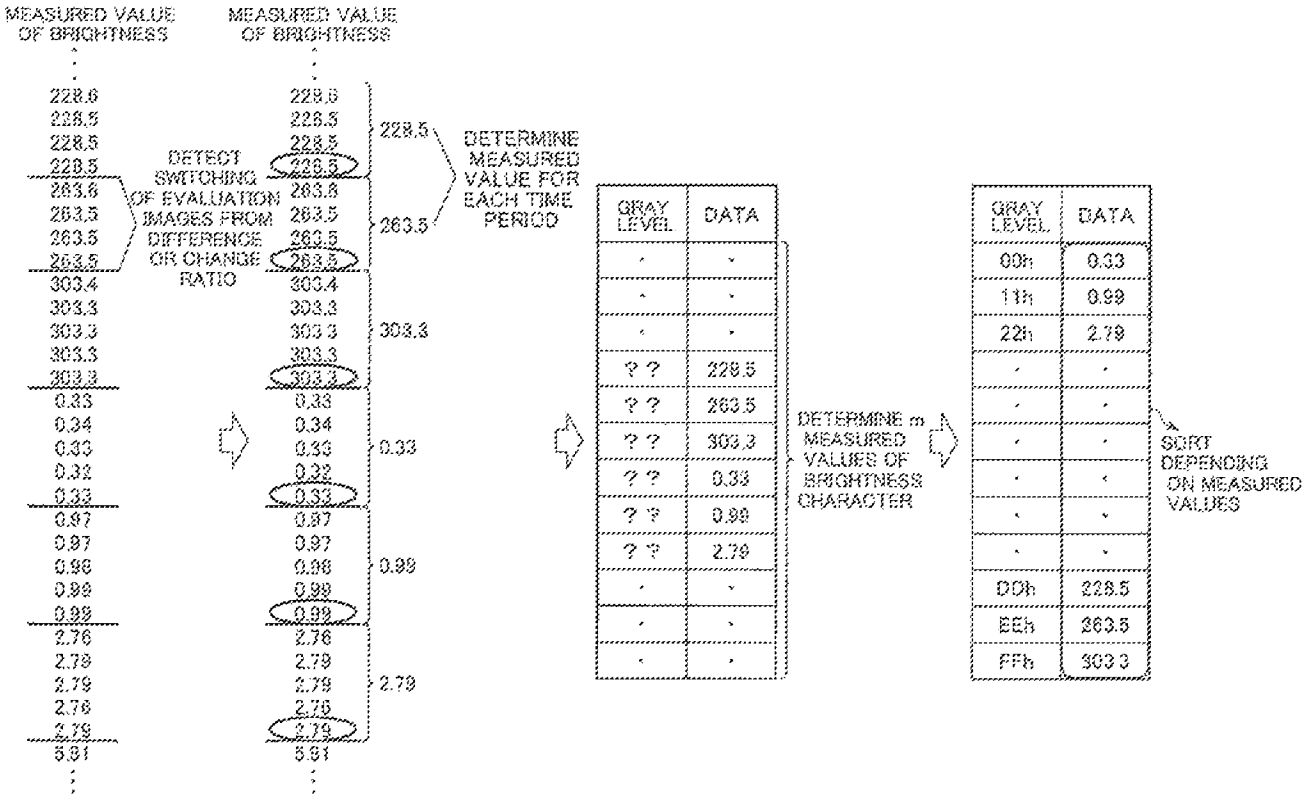
FIG. 14 is a conceptual diagram illustrating detection of switching the gray level of an evaluation image and determination of the relation between the gray level and measurement data in the second embodiment.

FIG. 14 is a conceptual diagram illustrating details of the detection or the switching of the gray level of the evaluation image at step S28 and the determination of the association of the gray levels with the measurement data by sorting the measurement data. FIG. 14 illustrates the determination of the association of the gray levels with the measurement data in the case when the register value REG_GAM_STEP is 11h and the gray level of each color of each pixel is represented by eight bits in the image data, that is, the allowed maximum value of the gray level in the evaluation image is 255 ($=2^8-1$ (FFh)).

When the gray level of the evaluation image is switched, the measurement data obtained by the display characteristics measurement device 6 exhibit a change due to a change in the image characteristics of the evaluation image displayed on the display section 31. The switching of the gray level of the evaluation image is detected by using this change. FIG. 14 illustrates an example in which the switching of the gray level of the evaluation image is detected from a change in the measured value of the brightness of the evaluation image. In this example, the change (the difference or the change ratio) of every two measurement values of the brightness obtained at adjacent timings is calculated, and the switching of the gray level of the evaluation image is detected from the calculated change.

When a switching of the gray level of the evaluation image is detected, the measurement data are determined for the gray level before the switching at step S29. In the example of FIG. 14, the measurement data obtained immediately before the switching are determined as the measurement data corresponding to the gray level immediately before the switching. It should be noted that the actual value of the gray level associated with each measurement date is unknown for the adjustment device 5 at this stage.

Measurement data are obtained for all the evaluation images by repeating the above-described procedure. It should be noted that the adjustment device 5 can determine that the measurement data are obtained for all the evaluation images by detecting m times of switching of the gray levels, since the number m of the evaluation images to be displayed on the display section 31 has been calculated at step S24 from the allowed maximum value of the gray levels and the increment of the gray levels in the switching of one evaluation images. At this stage, the gray level associated with each measurement data is still unknown to the adjustment device 5.

The measurement data include the measured values of the brightness of the evaluation images, and therefore the association of the gray levels with the measurement data of the image characteristics of the evaluation image displayed on the display section 31 can be determined by sorting the measurement data in the order of the brightness. In the case when the liquid crystal display panel 3 is configured as a normally-black liquid crystal display panel, the measured value of the brightness is increased as the gray level is increased. In this case, the association of the gray levels with the measurement data of the image characteristics of the evaluation image displayed on the display section 31 is determined so that measurement data with a larger measurement value are associated with a larger gray level. In the case when the liquid crystal display panel 3 is configured as a normally-white liquid crystal display panel, on the other hand, the measured value of the brightness is decreased as the gray level is increased. In this case, the association of the gray levels with the measurement data of the image characteristics of the evaluation image displayed on the display section 31 is determined so that measurement data with a smaller measurement value are associated with a larger gray level.

After the first measurement of the display characteristics of the display device 10 is completed by the above-described procedure (step S33), the correction parameter calculation period is started. In the correction parameter calculation period, the correction parameter calculator 55 calculates the brightness correction parameter values REG_CORRECTION from the measured display characteristics of the display device 10, that is, the image characteristics of the evaluation image displayed on the display section 31 so that desired display characteristics are achieved (step S34).

After the calculation of the brightness correction parameter values REG_CORRECTION is completed, the correction parameter write period starts. In the correction parameter write period, the brightness correction parameter values REG_CORRECTION calculated at step S34 are transmitted to the display controller/driver 2 via the interface unit 51 and written into the register initial value ROM 27 and the brightness correction parameter setting register 28*b* (step S35). As shown in FIG. 13, the write of the brightness correction parameter values REG_CORRECTION is achieved by transmitting a correction parameter write command to the display controller/driver 2. The interface unit 21 of the display controller/driver 2 writes the brightness correction parameter values REG_CORRECTION described in the correction parameter write command into the register initial value ROM 27 and the brightness correction parameter setting register 28*b*.

This is followed by measuring the display characteristics of the display device 13 in the same way again (steps S25 to S32). In this operation, the brightness correction circuit 23 performs the correction calculation on the received image data IMAGE_DATA_I (that is, the evaluation image data IMAGE_DATA_II) in response to the brightness correction parameter values REG_CORRECTION set to the brightness correction parameter setting register 28*b*, and the evaluation images are displayed on the display section 31 in response to the corrected image data obtained by the correction calculation. Furthermore, it is checked from the result of the second measurement whether the display characteristics of the display device 10 fall in a desired range (step S36). This completes the procedure.

The above-described adjustment method in the second embodiment, as is the case with the first embodiment, allows adjusting the display characteristics of the display device 10 with the cost-reduced adjustment device 5. Is should be especially noted that the evaluation images displayed on the display section 31 can be switched only by setting the register value REG_GAM_TEST of the test mode setting register 28*a* (more specifically, only by setting the register value REG_GAM_TEST to "1") in this embodiment. This result from the fact that the display controller/driver 2 has the function of automatically generating image data corresponding to evaluation images and the timing control signals controlling the display timing of the evaluation images (for example, the vertical synchronization signal and the horizontal synchronization signal) and thereby sequentially displaying the evaluation images on the display section 31. The provision of the function of sequentially switching evaluation images only in response to register setting to the display controller/driver 2 effectively leads to various advantages, such as a reduction in the cost and an improvement in the design easiness.

In addition, the number of the communication lines connected between the display controller/driver 2 and the adjustment device 5 can be reduced in the second embodiment, since control signals (for example, the test enable signal GAM_TEST_ENABLE and the evaluation image switching signal GAM_TEST_INC used in the first embodiment) are not fed from the display controller/driver 2 to the adjustment device 5. This effectively facilitates the actual implementation of the display device 10 (for example, the connection of the display device 10 to the adjustment device 5).

Third Embodiment

Figure 15:
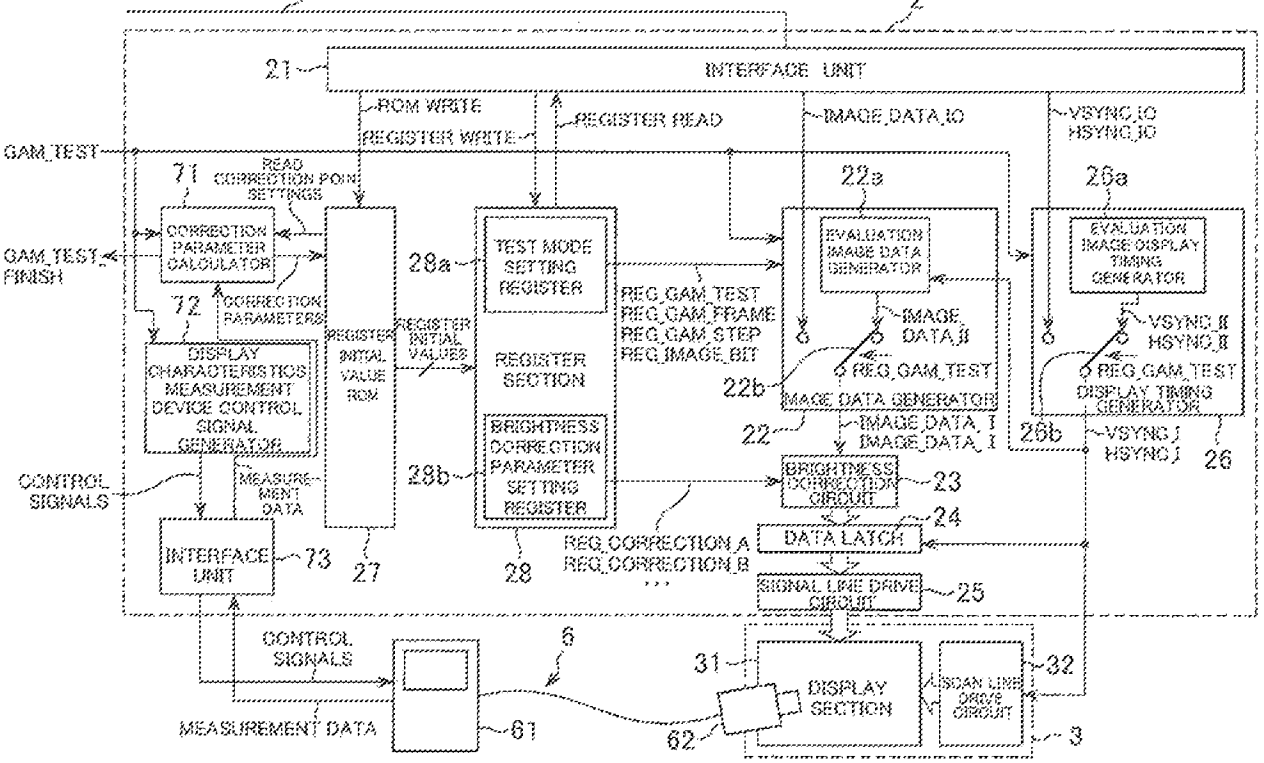
FIG. 15 is a block diagram illustrating an exemplary configuration of a display controller/driver in a third embodiment of the present invention.

FIG. 15 is a block diagram illustrating an exemplary configuration of the display controller/driver 2 in a third embodiment of the present invention. In the third embodiment, the function of the adjustment device 5 of the first embodiment is incorporated into the display controller/driver 2. In other words, the display controller/driver 2 is additionally equipped with the function of operating the display characteristics measurement device 6; the adjustment device 5 is not used in this embodiment. In addition, the display controller/driver 2 is configured to receive a test enable signal GAM_TEST, which is activated when the settings of the brightness correction circuit 23 are adjusted, and to output a correction completion signal GAM_TEST_FINISH indicating the completion of setting of the brightness correction circuit 23.

More specifically, the display controller/driver 2 of the third embodiment includes: a display characteristics measurement device control signal generator 71 generating display characteristics measurement device control signals; a correction parameters calculator 72 calculating the brightness correction parameter values REG_CORRECTION to be finally written into the register initial value ROM 27; and an interface unit 73 used for communications with the display characteristics measurement device 6. The operation of the display characteristics measurement device control signal generator 71 is the same as that of the display characteristics measurement device control signal generator 54 of the adjustment device 5 of the first embodiment, and the operation of the correction parameter calculator 72 is the same as that of the correction parameter calculator 55 of the adjustment device 5 of the first embodiment. The display characteristics measurement device control signal generator 71 and the correction parameter calculator 72 may be integrated in a form of hardware (that is, circuits) in the display controller/driver 2. Instead of integrating the display characteristics measurement device control signal generator 71 and the correction parameter calculator 72 in a form of hardware, the functions thereof may be realized by a combination of software and a processor.

The test enable signal GAM_TEST is fed to the image data generator 22, the display timing generator 26, the display characteristics measurement device control signal generator 71 and the correction parameter calculator 72. When the test enable signal GAM_TEST is activated, the image data generator 22 outputs the evaluation image data IMAGE_DATA_II as the image data IMAGE_DATA_I to be fed to the brightness correction circuit 23. In detail, the evaluation image data generator circuit 22*a* of the image data generator 22 outputs the evaluation image data IMAGE_DATA_II in response to the activation of the test enable signal GAM_TEST, and the selector 22*b* selects the evaluation image data IMAGE_DATA_II received from the evaluation image data generator circuit 22*a* as the image data IMAGE_DATA_I to be fed to the brightness correction circuit 23.

In the meantime, when the test enable signal GAM_TEST is activated, the display timing generator 26 outputs the timing control signals generated by the evaluation image display timing generator circuit 26*a* as the timing control signals to be used in the respective circuits of the display controller/driver 2. More specifically, in response to the activation of the test enable signal GAM_TEST, the evaluation image display timing generator circuit 26*a* outputs the internal vertical synchronization signal VSYNC_II and the internal horizontal synchronization signal HSYNC_II. The selector 26*b* outputs the internal vertical synchronization signal VSYNC_II and the internal horizontal synchronization signal HSYNC_II received from the evaluation image display timing generator circuit 26*a* as the vertical synchronization signal VSYNC_I and the horizontal synchronization signal HSYNC_I to be used in the respective circuits of the display controller/driver 2.

The other configuration of the display controller/driver 2 in the third embodiment is the same as that in the first embodiment.

Figure 16:
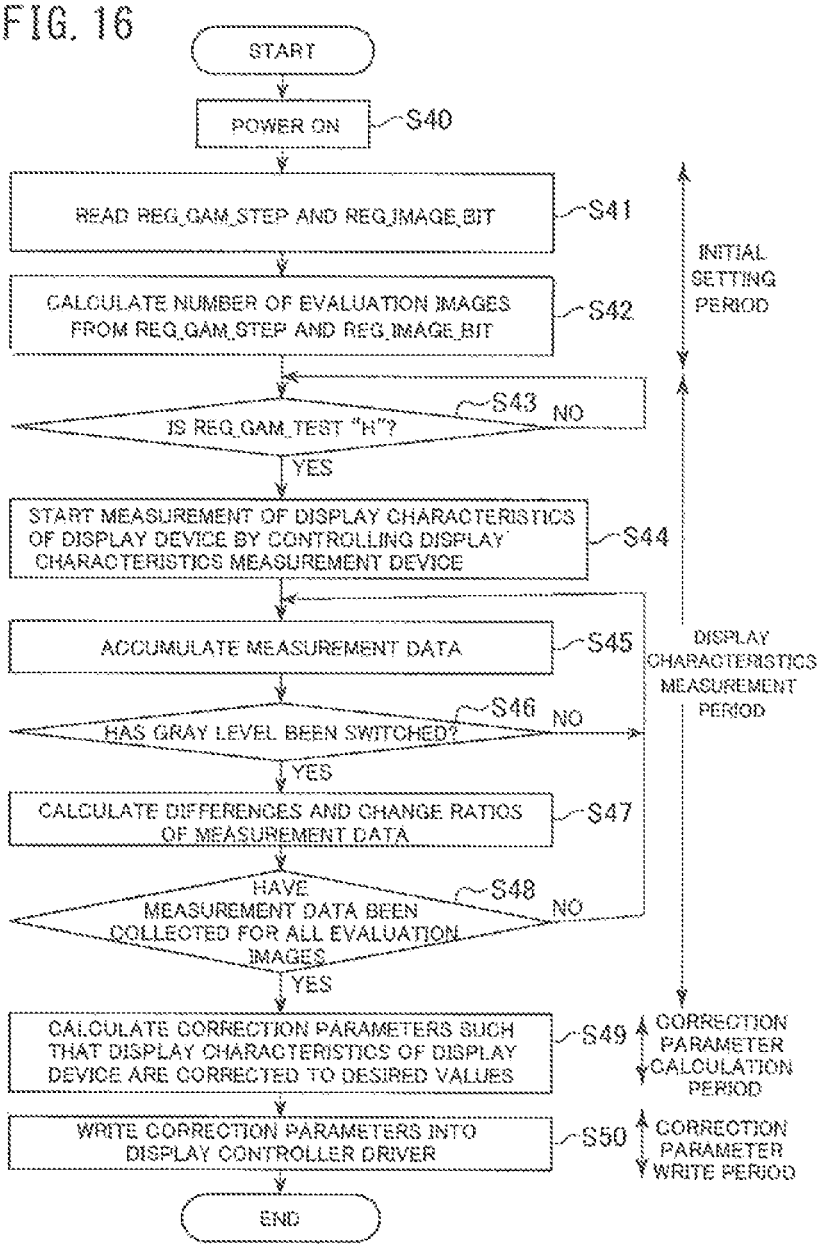
FIG. 16 is a flow chart illustrating an exemplary operation of the display controller/driver in the adjustment of the display characteristics of the display device (that is, the adjustment of the settings of a brightness correction circuit of the display controller/driver) in the third embodiment.
Figure 17:
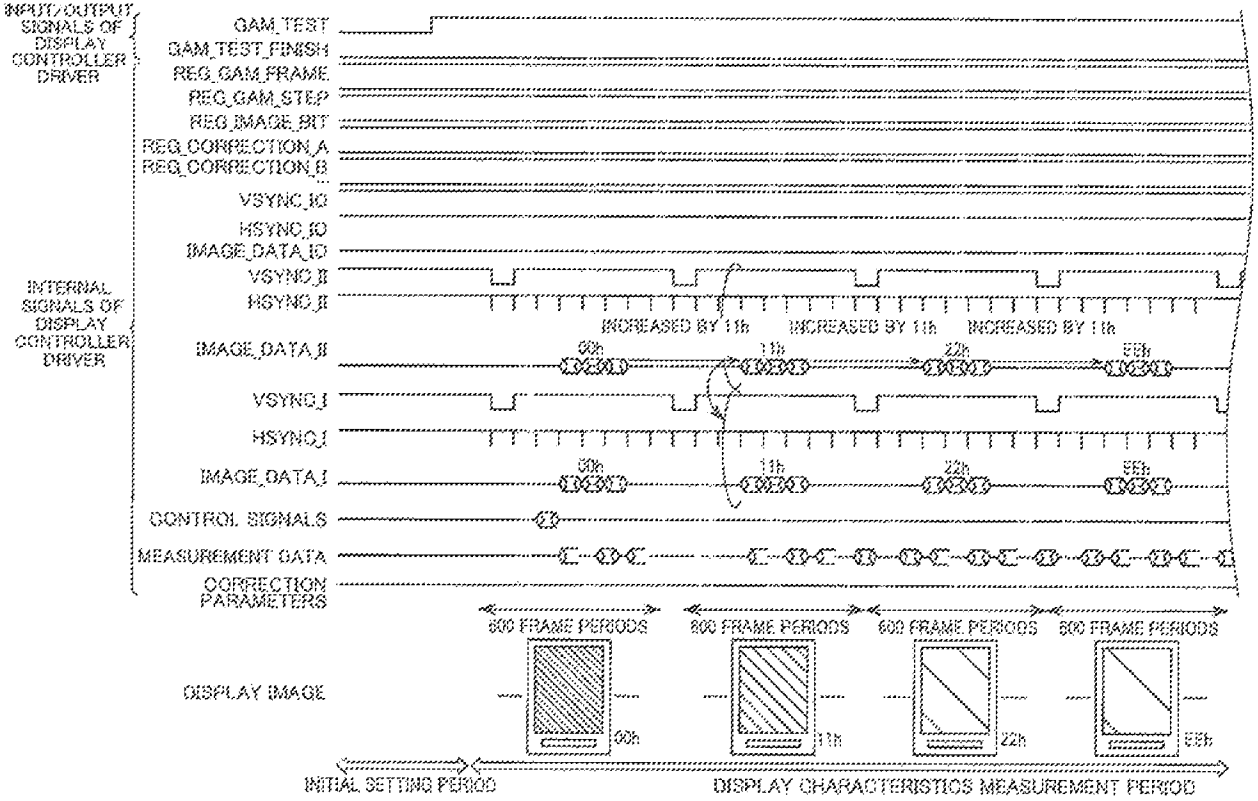
FIGS. 17 and 18 are timing charts illustrating an exemplary operation of the display controller/driver in the adjustment of the settings of a brightness correction circuit in the third embodiment.
Figure 18:
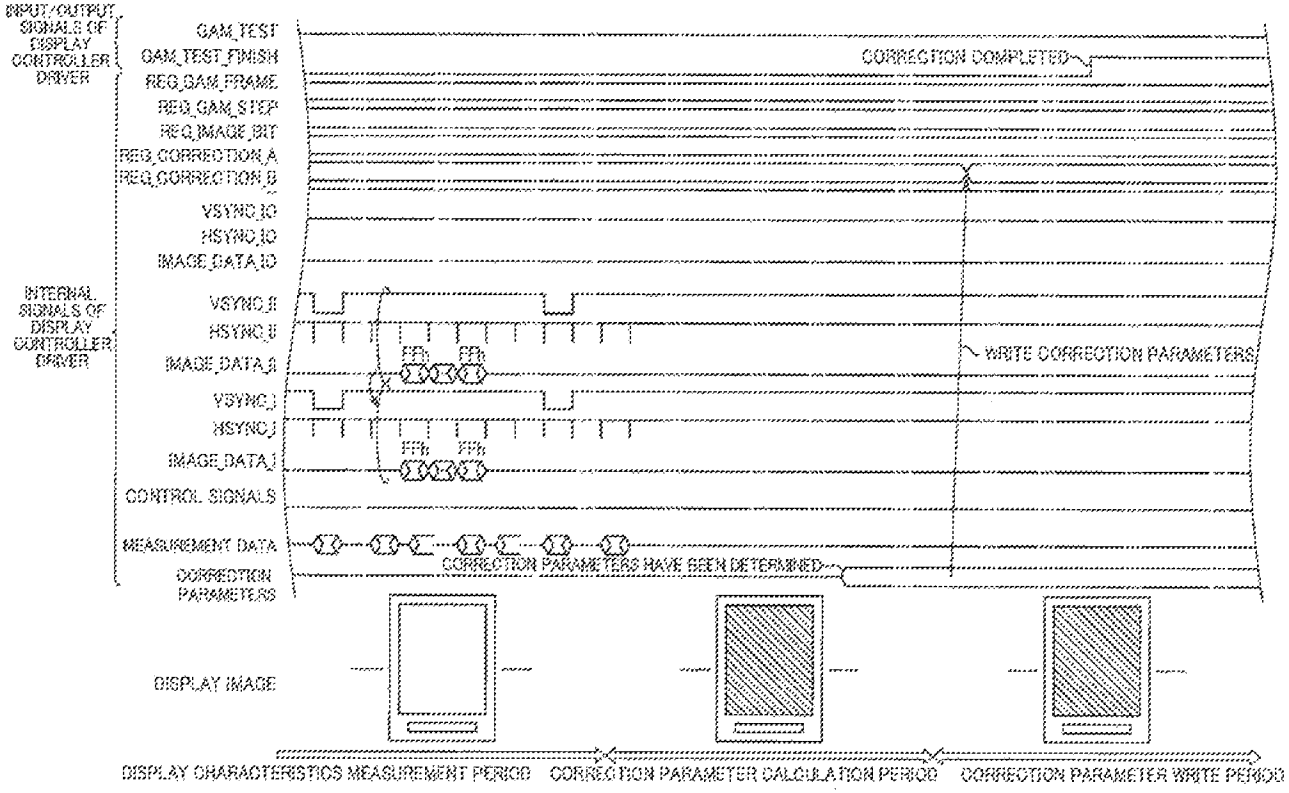

FIG. 16 is a flow chart illustrating an exemplary operation of the display controller/driver 2 of the third embodiment in the adjustment of the display characteristics of the display device 10, that is, the adjustment of the settings of the brightness correction circuit 23 of the display controller driver 2. FIG. 17 is a timing chart illustrating an exemplary operation of the display controller/driver 2 of the third embodiment in the initial setting period and the display characteristics measurement period, and FIG. 18 is a timing chart illustrating an exemplary operation of the display controller/driver 2 of the third embodiment in the correction parameter calculation period and the correction parameter write period.

The register initial value ROM 27 of the display controller/driver 2 stores the initial values of the following three register values: REG_GAM_FRAME, REG_GAM_STEP and REG_IMAGE_BIT (it should be noted that the register value REG_GAM_TEST is not used and the test enable signal GAM_TEST is fed to the display controller/driver 2 instead). In addition, the register initial value ROM 27 stores initial values of the brightness correction parameter values REG_CORRECTION to be set to the brightness correction parameter setting register 28*b*. It should be noted that, before the adjustment of the settings of the brightness correction circuit 23, as the initial values of the brightness correction parameter setting register 28*b*, the register initial value ROM 27 stores the brightness correction parameter values REG_CORRECTION defined so that the relation between the gray level values of the image data inputted to the brightness correction circuit 23 and those of the image data outputted form the brightness correction circuit 23 is set linear.

Referring now to FIG. 16, the power of the display controller/driver 2 is first set ON in the initial setting period (step S40). In response to the power-on of the display controller/driver 2, the initial values of the register values REG_GAM_FRAME, REG_GAM_STEP and REG_IMAGE_BIT are read out from the register initial value ROM 27 and set to the test mode setting register 28*a*. In addition, the initial values of the brightness parameter values REG_CORRECTION are set to the brightness correction parameter setting register 28*b*.

Furthermore, the register values REG_GAM_STEP and REG_IMAGE_BIT are read out from the brightness correction parameter setting register 28*b* to the correction parameter calculator 72 (step S41). The correction parameter calculator 72 calculates the number of evaluation images used for the adjustment of the settings of the brightness correction circuit 23 from the register values REG_GAM_STEP and REG_IAMGE_BIT (step S42).

This is followed by starting the display characteristics measurement period. In the display characteristics measurement period, the test enable signal GAM_TEST is first activated. In this embodiment, the test enable signal GAM_TEST is a high-active signal. In other word, when activated, the test enable signal GAM_TEST is set to the high level. The display controller/driver 2 is placed into the test mode in response to the activation of the test enable signal GAM_TEXT.

When the display controller/driver 2 is placed into the test mode, the generation of the evaluation images and timing control signals is started in the display controller/driver 2. The operation for the generation of the evaluation images and timing control signals in the display controller/driver 2 in the third embodiment is the same as that in the display controller/driver 2 in the first embodiment.

In detail, the evaluation image data generator circuit 22*a* of the image data generator 22 is activated in response to the activation of the test enable signal GAM_TEST, starts generating the evaluation image data IMAGE_DATA_II. In addition, the selector 22*b* selects the evaluation image data IMAGE_DATA_II as the image data IMAGE_DATA_I fed to the brightness correction circuit 23.

Furthermore, the evaluation image display timing generator circuit 26*a* of the display timing generator 26 is activated in response to the activation of the test enable signal GAM_TEST, and starts generating the internal vertical synchronization signal VSYNC_II and the internal horizontal synchronization signal HSYNC_II. In addition, the selector 26*b* selects the internal vertical synchronization signal VSYNC_II and the internal horizontal synchronization signal HSYNC_II, which are generated by the evaluation image display timing generator circuit 26*a*. As a result, as shown in FIG. 17, the internal vertical synchronization signal VSYNC_II and the internal horizontal synchronization signal HSYNC_II are outputted from the display timing generator 26 as the vertical synchronization signal VSYNC_I and the internal horizontal synchronization signal HSYNC_I, which are actually used in the respective circuits in the display controller driver 2.

The evaluation image data generator circuit 22*a* sequentially switches the evaluation image data IMAGE_DATA_II in synchronization with the vertical synchronization signal VSYNC_I and the horizontal synchronization signal HSYNC_I, that is, in synchronization with the internal vertical synchronization signal VSYNC_II and the internal horizontal synchronization signal HSYNC_II, which are generated by the evaluation image display timing generator circuit 26*a*. FIGS. 17 and 18 illustrate a specific example of the switching of the evaluation image data IMAGE_DATA_II, that is, the switching of the evaluation images displayed on the display section 31 at the bottom.

The brightness correction circuit 23 feeds image data corresponding to the received image data IMAGE_DATA_I (that is, the evaluation image data IMAGE_DATA_II) to the signal line drive circuit 25. In this operation, the brightness correction circuit 23 feeds the image data IMAGE_DATA_I to the signal line drive circuit 25 as they are, since the brightness correction parameter values REG_CORRECTION are fed from the brightness correction parameter setting register 28*b* to the brightness correction circuit 23 so that the relation between the gray levels of image data inputted to the brightness correction circuit 23 and those of image data outputted from the brightness correction circuit 23 is set linear before the adjustment of the settings of the brightness correction circuit 23. The signal line drive circuit 25 drives the signal lines of the display section 31 of the liquid crystal display panel 3 in response to the image data received from the brightness correction circuit 23. As a result, the evaluation images are displayed on the display section 31.

In parallel with the display of the evaluation images on the display section 31, the display characterizations measurement device control signal generator 71 starts measuring the display characteristics of the display device 10, that is, the image characteristics of the evaluation images displayed on the display section 31, by operating the display characteristics measurement device 6 (steps S44 to S48). In detail, the display characterizations measurement device control signal generator 71 transfers the display characterizations measurement device control signals to the display characteristics measurement device 6 via the interface unit 73 to thereby cause the display characteristics measurement device 6 to start measurement of the image characteristics of the evaluation images displayed on the display section 31 (step S44).

The display characteristics measurement device 6 starts the measurement in response to the display characterizations measurement device control signals receivcd from the display characterizations measurement device control signal generator 71 and continuously measures the images characteristics of the evaluation images displayed on the display section 31. The image characteristics to be measured include image characteristics used for adjustment of the white point and image characteristics used for adjustment of the gamma value. In one embodiment, the chromaticity coordinates x and y defined in the xyY color system may be measured as the image characteristics used for adjustment of the white point. Alternatively, the color temperature of each evaluation image may be directly measured. Also, the brightness of each evaluation image displayed on the display section 31 may be measured as the image characteristics used for adjustment or the gamma value. The display characteristics measurement device 6 sequentially transmits the measurement data of the image characteristics of the evaluation images to the display controller/driver 2.

The measurement data transmitted from the display characteristics measurement device 6 to the display controller/ driver 2 are stored in the correction parameter calculator 72 via the interface unit 73 (step S45). The correction parameter calculator 72 stores the measurement data transmitted to the display controller/driver 2 so that the measurement data are correlated with the gray level of the evaluation image.

During this operation, the correction parameter calculator 72 recognizes the switching of the gray levels of the evaluation images on the basis of the register value REG_GAM_FRAME set to the test mode setting register 28*a*, the vertical synchronization signal VSYNC_I and the activation of the evaluation image switching signal GAM_TEST_INC (step S46). When recognizing that the gray levels of the evaluation image are switched, the correction parameter calculator 72 determines the measurement result for the gray level immediately before the switching, on the basis of the measurement data obtained before the switching of the gray level (step S47). In one example, the measurement result for each gray level may be determined as the measurement data obtained immediately before the switching of the gray levels of the evaluation images. The correction parameter calculator 72 then accumulates measurement data for the next gray level.

The above-described operation is repeatedly performed until the collection of the measurement data of the display characteristics are completed for all the evaluation images (step S48).

After the collection of the measurement data of the display characteristics are completed for all the evaluation images, the display characteristics measurement device control signal generator 71 transmits the characteristics measurement device control signals to the display characteristics measurement device 6 via the interface unit 73 to stop the measurement of the image characteristics of the evaluation images displayed on the display section 31. This terminates the display characteristics measurement period.

This is followed by starting the correction parameter calculation period. In the correction parameter calculation period, the correction parameter calculator 72 calculates the brightness correction parameter values REG_CORRECTION from the measured display characteristics of the display device 10, that is, the image characteristics of the evaluation image displayed on the display section 31 so that desired display characteristics are achieved (step S49).

After the calculation of the brightness correction parameter values REG_CORRECTION is completed, the correction parameter write period starts. In the correction parameter write period, the brightness correction parameter values REG_CORRECTION calculated at step S49 are written into the register initial value ROM 27 and the brightness correction parameter setting register 28*b* (step S50) and, after the writing of the brightness correction parameter values REG_CORRECTION is completed, the correction parameter calculator 72 informs an external device of the completion of the setting of the brightness correction circuit 23 by activating the correction completion signal GAM_TEST_FINISH.

The above-described adjustment method in the third embodiment allows adjusting the display characteristics of the display device 10 with a cost-reduced external device. Is should be especially noted that, in this embodiment, the image data corresponding to the evaluation images and the timing control signals are automatically generated in the display controller/driver 2 and the evaluation images displayed on the display section 31 are sequentially displayed on the display section 31, only by activating the test enable signal GAM_TEST. In addition, the display characteristics measurement device control signals, which control the display characteristics measurement device 6, are generated by the display characteristics measurement device control signal generator 71 of the display controller/driver 2. Furthermore, the correction parameter calculator 72 analyzes the measurement data transmitted from the display characteristics measurement device 6 to calculate the brightness correction parameter values REG_CORRECTION, and writes the calculated brightness correction parameter values REG_CORRECTION into the register initial value ROM 27. In this way, the display characteristics of the display device 10 can be adjusted by an external device which has only the functions of activating the test enable signal GAM_TEST and receiving and handling the correction completion signal GAM_TEST_FINISH. This effectively leads to further advantages, such as a further reduction in the cost and improvement in the design easiness.

Although various embodiments of the present invention are specifically described in the above, the present invention is not limited to the above-described embodiments. It would be apparent to a person skilled in the art that the present invention may be implemented with various modifications. It should be especially noted that, although embodiments in which the present invention is applied to liquid crystal display devices including a liquid crystal display panel are specifically described in the above, the present invention is applicable to panel display devices in which a display panel driver drives a different type of display panel (such as, organic electroluminescence display panels and plasma display panels).

What is claimed is:

1. A display driver comprising:

a brightness correction circuit configured to generate corrected image data based on evaluation image data;

driver circuitry configured to drive a display panel with the corrected image data; and an interface unit configured to write a correction parameter value in a storage element based on a correction parameter write command, wherein the correction parameter value corresponds to a relationship between the evaluation image data and the corrected image data.

2. The display driver of claim 1, wherein the evaluation image data comprises evaluation images.

3. The display driver of claim 2, further comprising a display timing generator configured to, in a first state: output an internal timing control signal, and wherein the driver circuitry is further configured to drive the display panel with the evaluation images based on the internal timing control signal.

4. The display driver of claim 2, wherein the evaluation images are automatically generated.

5. The display driver of claim 2, wherein generating the evaluation image data comprises switching from a first evaluation image of the evaluation images to a second evaluation image of the evaluation images.

6. The display driver of claim 5, wherein switching from the first evaluation image to the second evaluation image is based on a cycle period of frame periods.

7. The display driver of claim 1, further comprising:

an image data generator configured to:

in a first state, generate the evaluation image data, wherein grey level values of each pixel in each evaluation image of the evaluation image data are the same;

change the grey level values when switching between evaluation images; and in a second state, provide image data received from an external source.

8. The display driver of claim 1, wherein the display driver is configured to:

measure image characteristics of evaluation images displayed on the display panel; and determine the correction parameter value.

9. A display driver comprising:

an image data generator configured to, in a first state:

generate evaluation images, wherein grey level values of each pixels in each of the evaluation images are the same; and change the grey level values when switching between the evaluation images;

a brightness correction circuit configured to generate corrected image data based on the evaluation images; and driver circuitry configured to drive a display panel with the corrected image data.

10. The display driver of claim 9, wherein switching between the evaluation images comprises switching from a first evaluation image of the evaluation images to a second evaluation image of evaluation images in response to an internal timing control signal.

11. The display driver of claim 9, wherein the driver circuitry is further configured to drive the display panel with the evaluation images.

12. The display driver of claim 9, wherein the display driver is configured to:

measure image characteristics of the evaluation images displayed on the display panel; and determine a correction parameter value.

13. The display driver of claim 9, further comprising:

an interface unit configured to write a correction parameter value in a storage element based on a correction parameter write command, wherein the correction parameter value corresponds to a relationship between the evaluation images and the corrected image data.

14. A display device comprising:

a display panel comprising a plurality of pixels; and a display driver comprising:

a brightness correction circuit configured to generate corrected image data based on evaluation image data;

driver circuitry configured to drive the plurality of pixels with the corrected image data; and an interface unit configured to write a correction parameter value in a storage element based on a correction parameter write command, wherein the correction parameter value corresponds to a relationship between the evaluation image data and the corrected image data.

15. The display device of claim 14, wherein the evaluation image data comprises evaluation images.

16. The display device of claim 15 wherein the evaluation images are automatically generated.

17. The display device of claim 15, wherein generating the evaluation image data comprises switching from a first evaluation image of the evaluation images to a second evaluation image of the evaluation images.

18. The display device of claim 17, wherein switching from the first evaluation image to the second evaluation image is based on a cycle period of frame periods.

19. The display device of claim 14, further comprising:

an image data generator configured to:

in a first state, generate the evaluation image data, wherein grey level values of each pixel in each evaluation image of the evaluation image data are the same;

change the grey level values when switching between evaluation images; and in a second state, provide image data received from an external source.

20. The display device of claim 14, wherein the display driver is configured to:

measure image characteristics of evaluation images displayed on the display panel; and determine a correction parameter value.

* * * * *